US006173653B1

(12) United States Patent
Edelmann

(10) Patent No.: US 6,173,653 B1
(45) Date of Patent: Jan. 16, 2001

(54) MODULAR STATION PLATFORM CONSTRUCTION KIT

(75) Inventor: Horst Edelmann, Burbach (DE)

(73) Assignee: Hering GmbH & Co. KG, Burbach (DE)

( * ) Notice: Under 35 U.S.C. 154(b), the term of this patent shall be extended for 0 days.

(21) Appl. No.: 09/091,206

(22) PCT Filed: Oct. 9, 1997

(86) PCT No.: PCT/EP97/05571

§ 371 Date: Jun. 10, 1998

§ 102(e) Date: Jun. 10, 1998

(87) PCT Pub. No.: WO98/15691

PCT Pub. Date: Apr. 16, 1998

(30) Foreign Application Priority Data

Oct. 10, 1996 (DE) ..... 196 41 800

(51) Int. Cl.[7] ..... B61B 1/00

(52) U.S. Cl. ..... 104/27; 104/30

(58) Field of Search ..... 104/27, 28, 30, 104/31

(56) References Cited

U.S. PATENT DOCUMENTS 2,652,783 * 9/1953 Skinner ..... 104/31

* cited by examiner

*Primary Examiner*—S. Joseph Morano
*Assistant Examiner*—Robert J. McCarry, Jr.
(74) *Attorney, Agent, or Firm*—Friedrich Kueffner

(57) ABSTRACT

Prefabricated kit for producing a station platform which is variable in its dimensions, in which platform slabs (1) are laid on foundations (4) with interposition of spacer elements (3). The spacer elements (3) can be replaced without damaging the other construction elements (1, 3, 4). The platform slabs (1) may be arranged in various horizontal positions above the foundations (4) in order to compensate for horizontal differences in size in relation to the axis of the track.

28 Claims, 16 Drawing Sheets

MODULAR STATION PLATFORM CONSTRUCTION KIT

BACKGROUND OF THE INVENTION

1. Field of the Invention

The present invention relates to a variable station platform with one or more platform slabs.

2. Description of the Related Art

In conventional construction, station platforms are described as a stationary structure. Such station platforms are produced on the precondition that they should remain unchanged for many generations. However, static structures of this kind no longer meet the requirements of modern rail traffic. On the one hand, they are inflexible with regard to requirements emanating from new technical developments. On the other hand, they do not provide the possibility of carrying out unavoidable corrections relating to dimensions and spacings on the structure at a later time in a straightforward and cost-effective manner. Under the modern requirements for comfort and safety, it is no longer acceptable to tolerate such deviations without correction. Moreover, the conventional station platforms are to be criticized from a current standpoint for the complex, time-consuming and cost-intensive construction which impedes operation.

To simplify the construction of station platforms, in the past there have been attempts to use prefabricated kits for station platforms. For instance, EP-357 161 thus describes a station platform which is made up essentially of three basic elements. These are firstly U-shaped concrete pedestals which are set at fixed intervals parallel to the course of the rails.

Two longitudinal beams are then placed on the vertical limbs of the U-shaped concrete pedestals from one pedestal to another, which longitudinal beams run parallel to the rail. Subsequently, the longitudinal beams are covered from above with rectangular platform slabs, and all the connections and joints are closed and bonded. A station platform system of this type may reduce the construction time of a station platform compared to the fixed construction, but the handling of the solid longitudinal beams and the many platform slabs is still relatively complex. Moreover, the platform slabs are not protected against bending or "sagging" toward the unsupported center between the two longitudinal beams. A particular disadvantage should furthermore be mentioned, that the station platform is not suitable for later reconstruction without difficulty due to the permanently applied connection of the construction elements and, in particular, does not permit any dimensional adaptation of the system at all.

A station platform kit is also described in DE-43 16 203, which contains concrete foundations cast in situ, transverse beams and platform slabs. Here the transverse beams are attached to the concrete foundations cast in situ and platform slabs are then laid from one transverse beam to another, the said platform slabs containing support beams molded on to their underside in a box shape. These platform slabs are fixedly connected to the transverse beams. This system has similar disadvantages to those described above.

In particular, no provision is made for dimensional adaptation and height-adjustability, and the fixed connection of the components to one another results in a structure which cannot easily be changed at a later date.

In the laid-open publication DE 42 05 192 A1, a station platform is described, in which so-called spacer elements are arranged so as to be fixed against displacement on concrete foundations cast in situ and founded with spacing along the rail. Longitudinal supports which are parallel to the rails and parallel to one another are then laid from one spacer element to another and finally support a concrete slab cast in situ as the station platform. All the construction elements are secured against lateral displacement by means of bolts or similar means which pass right through. The laid-open publication emphasizes as an advantage the fact that, if the station platform is reconstructed at a later date, its height can easily be changed by raising the concrete slab cast in situ and replacing the spacer elements for different spacer elements. The station platform is produced at the site of installation in order that it can be made in one piece and to achieve better adaptation to curved areas. However, this production on site also has several disadvantages. On the one hand namely, permanent formwork is used which is only fixed in grooves. The width of the station platform is therefore limited for purely structural reasons because of the high loads exerted by the concrete covering cast in situ on the permanent formwork. Furthermore, concrete cast in situ must be allowed to set for up to 28 days, which extends the required construction time. Additionally, influences of weathering and frost may impede the construction site.

Furthermore, the station platform represented in the laid-open publication is a complete station platform as a rigid slab. This slab can only be removed by cutting the concrete. The destruction of the reinforcement therefore makes its reusability extremely limited.

A station platform (for streetcars) which is adjustable in height is also described in the article "Versenkbare Verkehrsinseln" [Lowerable traffic islands] (Verkehrstechnik [Traffic technology], Volume 24, Dec. 20, 1935, page 666). Here the platform slab rests in the normal state on four wooden blocks. By removing the wooden blocks, it can be lowered into the ground, i.e. adapted to street level. In this case, the platform slab is vertically movable within a given shaft.

The height-adjustability of the traffic island or the platform system disclosed in the abovementioned publication and in DE 42 05 192 A1 can, however, result in problems in practice, since the desired spacing of the platform edge from the axis of the track may vary between customary platform heights (e.g. 38 cm above the upper edge of the rails (SOK)) and greater platform heights (e.g. 55 cm, 76 cm and 96 cm above the SOK). In these cases, the height-adjustment may result in an undesirably and unacceptably large distance of the platform from the axis of the track or from the entrance to the carriage.

SUMMARY OF THE INVENTION

In contrast, the present invention has the task of providing a prefabricated kit for producing variable station platforms, which permits construction and dismantling of the station platform as well as exchange of components in a favorable manner in terms of time and costs, and which enables dimensions of the station platform, in particular the platform height, to be changed at a later date. The station platform should be mobile in the sense that it should be able to be set up again at a different site. The variation in height should avoid any disadvantages which may arise from changed distances to the axis of the track.

The station platform should furthermore be suitable to be mounted on top of the remains of the old station platform in the course of refurbishment measures with partial or complete use of the old platform edge with its associated strip foundations. Moreover, it should also be possible to construct it in difficult positions, e.g. on embankments. Finally, the station platform should also be able to serve as a provisional platform or temporary platform in such cases in which a platform is erected only for a specific period, e.g. in the form of a platform extension, because longer trains are to stop at a platform for a specific period, or for the case of a platform having to be erected temporarily at a different site and only being moved into its final position at a later date.

This object is achieved by means of a variable station platform, having one or more platform slabs which is variable particularly in height and which is defined by the fact that the platform slabs have supporting regions on their underside, within which regions they can be placed at any position on the supporting points of the platform substructure, and/or that the platform substructure has supporting regions on its top side, within which the platform slabs can be placed at any position, so that the platform slabs can be arranged in various horizontal positions above the foundations.

The variability for horizontal displacement of the platform slabs is preferably 5 to 20% of the platform width (typically about 1 m). The horizontal change in position of the platform slabs is made possible by appropriate constructional adaptation and design of the platform slabs and/or the platform substructure, so that a stable platform construction is obtained within the positional variability. With this design, a platform is obtained, which avoids the disadvantages of the prior art that, after a change in height, the horizontal distances from the axis of the track are unfavorable or unacceptable from the viewpoint of convenience and safety. A significant improvement has thus been achieved with regard to the usability of station platforms which are variable in height.

The horizontal variability in position can be achieved in such a way that the platform slabs have supporting regions on their underside, within which the supporting points of the platform substructure can be positioned at any desired position. In this case, the "supporting points of the platform substructure" are not only to be seen as punctiform, but may, for their part, be extended surfaces which may come only partially into contact with the platform slabs. Conversely, the platform substructure may also have supporting regions on its top side, within which the platform slabs (via supporting points or supporting regions) can be placed at any position.

It is particularly advantageous that, in the station platform system according to the invention, the foundations may lie outside the pressure area of the track. In this case, an escape space of about 70 cm is typically provided below the platform slab when the platform slab has a corresponding projection.

The platform slabs (and further elements of the platform) are preferably prefabricated components, thus resulting in a prefabricated kit to be produced by the works.

In a specific design, the station platform according to the invention may have one or more prefabricated spacer elements which are arranged, in the assembled state, between the platform slab and the foundations and can be replaced without damaging the other elements, i.e. in particular the foundations and the platform slab. In this case, the platform slab may rest, detachably connected or unconnected, on the spacer elements. The spacer elements, for their part, may likewise rest, detachably connected or unconnected, on the foundations. Furthermore, the station platform according to the invention is defined by the fact that the horizontal position of the platform slab on the spacer elements and/or the horizontal position of the spacer elements on the foundations is variable. The lateral position of the station platform is therefore variable during construction or reconstruction.

Surprisingly, the station platform according to the invention is adequate without any permanent connections between the construction elements. The fact that the platform is sufficiently stable with regard to the loads to which it is subjected is achieved solely by means of the design and arrangement of the construction elements. At the same time, however, the platform still remains just as easy to dismantle as it is to assemble for all time. It is thus possible, in particular, to replace the installed spacer elements, in the course of a reconstruction measure, for other spacer elements of different dimensions or to add or remove spacer elements. It is thus possible to move the platform edge to a new desired height and position in relation to the top edge of the rail. It is furthermore possible also to compensate for dimensional displacements by means of small-scale corrections. Reconstruction and adaptation measures of this type can be carried out on the platform according to the invention without great effort and with only short interruptions of operation. In particular, it is also advantageous that the platform slab rests in a self-supporting manner between the concrete foundations cast in situ or transverse beams, so that it can be gripped in this region in order to be raised. The latter would not be possible in a system according to EP-357 161, for example, since the longitudinal beams would be gripped together with the platform slabs.

Compared to the station platform according to the invention, the height-adjustable station platforms known from the prior art (DE 42 05 192 A1 and Verkehrstechnik 24, 666) do not have lateral displaceability, since the traffic island is guided by means of the shaft excavation and the platform system by means of securing elements. In contrast, with the platform according to the invention, it is also possible to react to changes in dimensions which occur, for example, at the transition from various customary platform heights (e.g. 38 cm above the SOK) to higher levels (e.g. 55–96 cm above the SOK). Particularly from the aspect of current demands for convenience and safety, such differences can no longer be tolerated without correction. Furthermore, the inventive production of the platform slab from various prefabricated components, instead of concrete cast in situ, has various advantages over DE 42 05 192 A1. For instance, with the prefabricated construction of the platform slab, the width of one platform slab is determined only by the maximum possible transport dimensions or weights. In contrast, in DE 42 05 192 A1, the width of the platform is limited by the permanent formwork. Moreover, a platform slab which has been prefabricated at the works can be used immediately after assembly. This considerably shortens the obstruction times on site since, as is well-known, concrete cast in situ must be allowed to set for up to 28 days. Additionally, prefabricated parts can also be assembled under extreme temperatures (frost). This is not the case with casting concrete in situ. This also results in greater flexibility with regard to the construction time.

A further significant advantage of a prefabricated platform slab compared to one cast in situ consists in the division into individual slab parts separated by joints. The platform system is thus mobile and reusable, and not simply variable in height. A platform made up of prefabricated parts can be dismantled completely within a short time. It is only necessary to cut the permanently elastic joints and remove the individual parts. In contrast, the platform illustrated in DE 42 05 192 A1 is a complete platform as a rigid slab, in which the concrete has to be cut up for reconstruction. In this case, the destruction of the reinforcement greatly restricts the reusability.

The outlay for the formwork of a platform section which, in the case of curved positions, lies in the transition curve, is also relatively small in the prefabricated structure according to the invention. The curve formwork only has to be adapted for each section of the platform. In contrast, the slipform reported in DE 42 05 192 A1 cannot be used in the transition curve. A prefabricated part therefore has less outlay in terms of formwork and thus also involves lower costs. Furthermore, the platform system according to the invention is of a completely modular construction and comprises replaceable individual components. It is therefore very easy to maintain, because all the individual parts can be replaced without difficulty. No breaking-off or cutting of the concrete is necessary. In reality, adaptations to station platforms are often necessary at a later date, e.g. the later incorporation of catenary supports, signals or even shafts. In such cases, either the slab can be replaced completely at the relevant position or only changed in part. Such a replacement only in the substructure is also possible. The prefabricated platform slab may already be given a surface, designed according to the requirements of the user, at the works. During later use, said surface is the surface of the platform subjected to foot traffic. Therefore no additional operation is necessary to tile the platform, for example, or to provide it with a surface suitable for foot traffic. Patterns of different colors are also possible. In contrast, in the case of DE 42 05 192 A1, an additional covering has to be applied to the concrete cast in situ. The works manufacture also ensures great dimensional accuracy and flexibility in the surface structure, e.g. also the use of concrete of different colors and different surface roughness in one slab. In the case of concrete cast in situ, this would mean an additional operation or even a greater maintenance outlay due to the poorer quality of the connection of the top covering to the platform slab. A further advantage of the surface which later lies in the formwork on its underside is the greater density of the concrete and homogeneity of the surface which can be achieved (flat plane of the vibrating table). The system construction according to the invention also permits very high dimensional accuracy, since the platform slab only needs to be adjusted once.

In the prefabricated platform slab according to the invention, obstructive systems in the platform area, such as for example existing supports, can be incorporated into the system, that is to say cutouts and slab sizes can be selected to leave the site of the obstructive systems open when the slabs are laid. Cutouts once planned may just as easily be closed again if the obstructive system is removed again at a later date. Existing low-level drainage systems between the track and the platform can also remain intact or cutouts are provided for them.

Basic stability of the arrangement is already ensured by the weight of the construction elements, in particular the platform slab. Loading of the platform which is conceivable under exceptional circumstances could be, for example, the fact that horizontal displacement of the construction elements could be caused by the impact of a rail vehicle. If a displacement of this type is not already sufficiently absorbed by the friction forces between the construction elements and their dead weight, according to a preferred design of the invention, provision may also be made for the construction elements to be anchored to withstand such horizontal loads by means of a particular, meshing shape. In this case, numerous different connection means are conceivable, which may work, for example, according to the tongue and groove principle. Stabilizing the parts against parallel displacement relative to one another by means of an appropriate, complementary, meshing shape can apply, on the one hand, both to the platform slab and the spacer elements and, on the other hand, to the spacer elements and the foundations. A particular preference is for the platform slab, spacer elements and foundations to mesh in each case by means of appropriate shaping. In this case, however, the retention against unintentional lateral displacement must be such that it does not prevent lateral variability which is required for the reconstruction of the platform. Toothing patterns should therefore permit, for example, different grid-like engagement positions, and screw connections could ensure corresponding flexibility by means of elongated holes.

For the spacer elements according to the invention, a subdivision into individual elements is possible; they preferably consist of two parts providing separate supports. However, it is also possible for the concrete foundations cast in situ not to be in once piece, but to be designed, for example, in pier construction or, for temporary situations, to consist of easily reusable stacks of railroad ties. In this case, the one-piece or multiple-piece spacer elements would also be designed as horizontal bars on drilled or driven piles. This variant is possible in difficult soil conditions or difficult positions, e.g. on embankments. Generally, however, the surface pressure resulting from the weight of the system platform and its fitting elements is so small that the above-mentioned foundation is sufficient.

If the spacers assigned to a foundation do not consist, in one piece, of one, but of two or more individual blocks, it is possible in a simple manner, in particular, to influence the inclination of the platform in the transverse direction (i.e. transversely to the direction of the rails). On the one hand, with a horizontal concrete foundation cast in situ, transverse inclinations of the platform slabs differing from the horizontal plane, may be caused by spacers of different thicknesses. Likewise, however, it is also possible, in concrete foundations cast in situ not made horizontally, to bring about compensation with the aid of spacers of different thicknesses or by introducing non-shrinking grouting compound, so that the platform slabs run horizontally or at a required transverse inclination as a roof or inverted roof profile. Finally, it should be noted that multiple-part spacer elements have a low individual weight and can thus be processed more easily.

The station platform according to the invention may be designed in the form of four different systems.

System I can be used for narrow platforms or an outdoor platform.

System II can be used for platforms of widths greater than 7 m, e.g. medium platforms.

System III can be used for platforms of widths less than 7 m, e.g. the edge regions of medium platforms.

System IV is a design for construction on top of an existing platform.

Typical designs of these systems are described in detail below.

System I

The platform slabs according to the invention preferably have support beams running in parallel in the longitudinal direction on their underside. These support beams given [sic] the platform slabs the necessary stability in the longitudinal direction. It is thus possible to design the platform slab itself to be less thick, which results in saving weight.

Likewise, according to a further preferred design of the invention, support beams running transversely to the longitudinal extent may also be arranged below the platform slab. Support beams of this type, which are preferably located at the beginning and at the end of the platform slab, prevent the platform slab from bending in the transverse direction. The spacing between these support beams permits, as a technical innovation, an arrangement of the platform in the radius of curvature provided by the relevant track course without changing the support construction of the platform system. Likewise as an innovation, the longitudinal edges of the platform may be designed in the given radius of curvature or according to other shape specifications.

The platform slabs according to the invention are preferably produced by the works so that cutouts for the passage of cable ducts are already incorporated in them. As a result, it is possible without difficulty to provide the necessary (in particular grounding and electrical) installations for the platform. Furthermore, the platform slabs according to the invention may already contain mounting sleeves for platform structures, such as for example weather protection devices or sign boards. Such premade devices complete the possibilities of rapid and easy installation of a platform with the modules according to the invention.

System II

The kit according to the invention comprises a prefabricated reinforced concrete slab which is stressed along one axis and has a regular width of, for example, 2–4 m. The length is half the platform width apart from exceptions as described below. The thickness of the slab only needs to be 14–20 cm. The slab itself has a gradient to conduct away the surface water into a continuous channel in the center of the platform or a gradient toward the track. The system also comprises two edge supports (support beams). These are self-supporting prefabricated joists in a regular length of up to 9 m. These edge supports absorb the vertical loads from the platform slab. They may be provided with a sound-absorbing surface toward the track (e.g. concrete with internal porosity of the aggregate particles). The system also comprises a trough element. This is also a self-supporting prefabricated support with a regular length of 9 m which absorbs the vertical loads from the platform slab and is supported on the foundation beam. Here it is possible to conduct cables inside the trough on the foundation beam or the spacer. The outside of the trough may be provided with a sound-absorbing layer or a sound-absorbing slab suspended in front of it. This is a requirement, particularly in this case, in residential areas in the local traffic network.

The system furthermore comprises a ground beam as a prefabricated foundation beam which is attached to the relevant edge of the platform slab, e.g. every 9 m, which beam reinforces the edge supports, connects the individual foundations and transmits and distributes the horizontal loads into the foundations. The foundations are made of prefabricated parts or concrete cast in situ and attached to each end of a platform slab. The spacer elements are designed as prefabricated parts and ensure the height-adjustability of the platform. The projection of the platform slab over the edge beam is variable, preferably 70 cm (so-called escape space), but may also be zero.

System III

This system can be used for platform widths of less than 7 m. It comprises a prefabricated slab which is stressed along one axis and has a regular width of 2–4 m, the length corresponds to the platform width, and the thickness may be made as in system II, the gradient likewise. Further constituent parts are edge supports as self-supporting prefabricated joists, ground beams as prefabricated beams, cast in situ concrete or prefabricated individual foundations and spacer elements as described for system II.

System IV

If it is to be built on top of an existing platform, a prefabricated slab is stressed along two axes and attached, supported in a punctiform manner, over an edge beam and a central beam; in the case of outdoor platforms over two edge beams. The height-adjustability and drainage are formed as in the abovementioned systems. Since the prefabricated foundation and edge beam are located about 70 cm or more from the platform edge, they do not touch the foundation of the old platform edge or the old platform edge itself. These 70 cm may serve as an escape space; such a space or larger space also has the advantage that the foundation work can be carried out without endangering the operation (outside the pressure area of the track). The foundations are individual foundations. The central support also has to be founded if it is a medium platform consisting of two platform slabs. Here too, the edge beams may be produced with a sound-absorbing surface toward the outside, as in the abovementioned systems, or have such a surface suspended in front of it.

In particular in conjunction with the system IV, a further technique for height-adjustability may be applied, in which the platform slab is supported on the platform substructure by means of height-adjustable feet. These height-variable feet may consist, for example, of a threaded anchor which can be screwed to different depths into the platform slab or the platform substructure. A bracing for the threaded anchor may be formed by a footing in the other respective component.

There are various solutions to conducting rainwater away. For instance, a drainage channel may be arranged along the longitudinal edge of the platform slab, preferably with an outdoor platform. In the case of medium platforms and large platform widths, it is also possible to conduct surface water away on both sides by means of an appropriate inclination to two sides.

A further variant is central drainage. In this case, a drainage duct may be installed in the joint between two platform slabs with a half channel/box channel below the joint. Depending on the longitudinal gradient of the slab, this drainage water is conducted away, for example every 9 m, and conducted off into the existing drainage system. This can be done by means of a cutout in the central trough (system II). Systems III and IV also provide the possibility of central drainage. By means of a curb on the side remote from the track, even heavy flow of rainwater can be concentrated on a few outlets. The advantage of the system according to the invention is that several variants of rainwater drainage are possible, and it can thus be adapted to the requirements of the user.

The surface of the platform slab is preferably fitted with an antislip surface and safety and conduction systems which can be incorporated. It can be produced in various colors and structures. In particular, it is possible to use different compositions of concrete to produce the surface. In this case, two or more different types of concrete may be used, e.g. those of different colors or different compositions (e.g. glass-fiber concrete and concrete with different aggregates). These can be introduced into the formwork successively and/or adjacently. It is also conceivable that they are arranged in a grid structure in which they are separated only by grid joints. By means of this use of different types of concrete, an attractive esthetic (including color) design of the platform slabs can be achieved as well as advantageous structural and functional properties.

In order to permit ease of assembly, in particular with the aid of rail-mounted cranes or excavators located on site, specific dimensions and weights of the construction elements are preferred. For instance, the weight of the platform slab should be less than 10,000 kg, preferably less than 8000 kg. The platform slab preferably has a width of 2 to 5 m, particularly preferably 2.50 to 3.0 m, and a length of 4 to 10 m, preferably 5 to 7.50 m.

Attachment means, such as point anchors, anchor rails or threaded sleeves, etc., may also be incorporated as a mounting aid for the optional attachment of supply lines, etc. on the underside of the slab, along the transverse and longitudinal supports and on the latter themselves.

Of course, the prefabricated kit according to the invention can also be used to great advantage even if no later reconstruction measures for the adaptation of dimensions are planned, but, on the contrary, a permanent platform is to be erected. The prefabricated construction of the platform according to the invention, which is favorable in terms of time and costs, benefits the user in any case, even if no later reconstruction measures are carried out with the platform.

In particular, however, it is part of the scope of the invention to use the prefabricated kit to erect a platform which is variable in height and laterally. Height adjustment of the platform by relatively large distances, e.g. from 38 cm to 96 cm above the upper edge of the rails is required, for example, when different rail vehicles are used. Such changes in the height requirements occur particularly frequently, especially in current times, with the modernization of traffic systems taking place. For instance, numerous traffic operations are being refitted with different carriage engineering, which necessitates refitting of the platforms. With the use of the platforms according to the invention which are variable in height and laterally, in this regard all options are being kept open for future developments which are not yet foreseeable. The platform according to the invention is of inestimable advantage, in particular when the modernization of a platform is currently due, and the necessity for refitting at a later point in time has already been established or is likely.

In the event of the platform having been installed as a provisional platform or temporary solution, and even in the event that partial exchange of platform slabs will be necessary at a later point in time, only the permanent elastic joints have to be cut and the slab can be removed as a whole unit without affecting the structural functions of the adjacent slabs.

The removed slabs can then be reused. For this purpose, only the permanent elastic joints have to be renewed. There is no disposal outlay.

Finally, the invention also relates to a method for the height and/or lateral adjustment of a platform made of a prefabricated kit according to the invention.

This method is defined by the fact that a) the platform slab is firstly raised, which can preferably be done by means of hydraulic presses, rail-mounted cranes and/or excavators, b) the spacer elements may be replaced by new spacer elements of the desired height or spacer elements may be added or removed or non-shrinking grouting compound may be applied below the spacer elements/platform slab, and c) the platform slab is placed on the spacer elements at the desired horizontal position.

This method according to the invention can be carried out with extremely little outlay and without great and prolonged interruptions of the rail operation. In particular, it is also possible to carry out small-scale corrections within the range of centimeters. Instead of replacing all the spacer elements, support elements between the components of the prefabricated kit can also be renewed or built up. This is because it is customary according to the prior art to attach so-called elastomer supports between such construction elements, e.g. in the form of neoprene strips. These support elements are arranged, on the one hand, between the platform slab and the spacer element and, on the other hand, the spacer element and the foundation. The toothed profile of the components reliably prevents horizontal displacement of the elastomer supports. Dimension tolerances in the platform slab and in the concrete foundation cast in situ or prefabricated foundation can also be compensated without difficulty by introducing non-shrinking grouting compound below the spacer elements or the platform slab.

Not insignificantly, it is also possible within the scope of the method according to the invention to exchange any construction elements which may have become damaged for new ones without requiring complete renewal of the platform.

BRIEF DESCRIPTION OF THE DRAWING

The invention is explained below by way of an example with the aid of the figures.

DESCRIPTION OF THE PREFERRED EMBODIMENT

Figure 1:
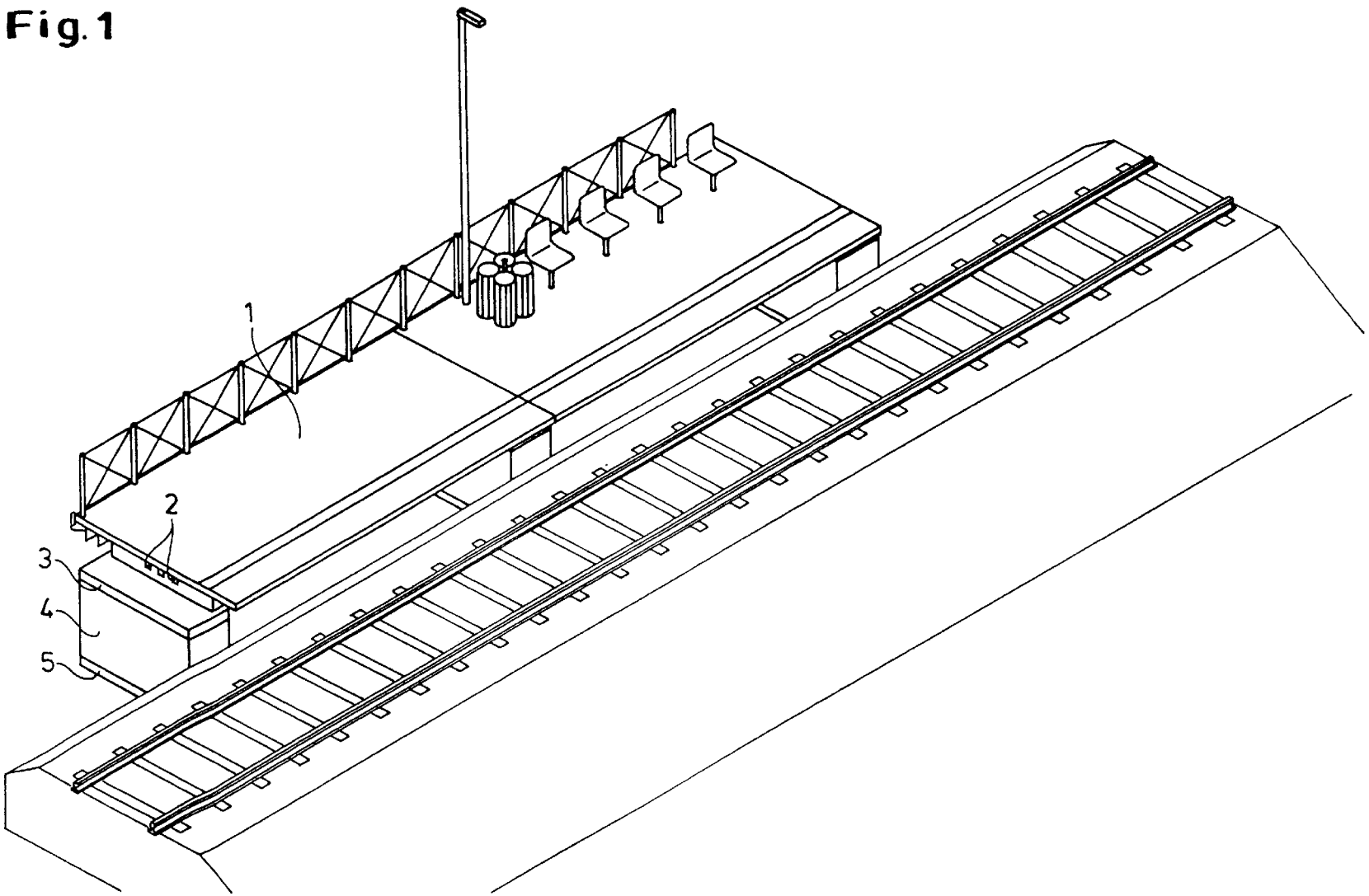
FIG. 1 shows a perspective view of the platform according to the invention (system I).

FIG. 1 shows a perspective view of a detail of the platform according to the invention in accordance with system I, comprising two basic sections (platform slabs 1). The platform runs parallel to the extent of the rails, in which case the top edge of the platform must maintain a given distance from the top edge of the rails. The platform according to the invention is erected on a granular subbase 5 or an old platform 5. The concrete foundations 4 cast in situ are firstly installed at specific intervals on said base. The spacing of said foundations corresponds to the length of the platform slabs 1. Located on the foundations 4 in one piece are the spacer elements 3. These are each arranged at the two end points of the foundations 4. The spacer elements 3 form, on the one hand, a defined supporting surface toward the platform slab 1 and, on the other hand, they are suitable as lightweight elements which can be replaced without difficulty and fulfill the height and lateral adjustability function of the platform. Replacing the spacer elements 3 makes it possible, without changing the platform slabs 1 or the concrete foundations cast in situ, to vary the height or position of the platform, even at a later date. Finally, the platform slabs 1 are laid from one foundation to another, in which case they bridge the gap in a stable manner on account of their own load-bearing capacity.

Figure 2:
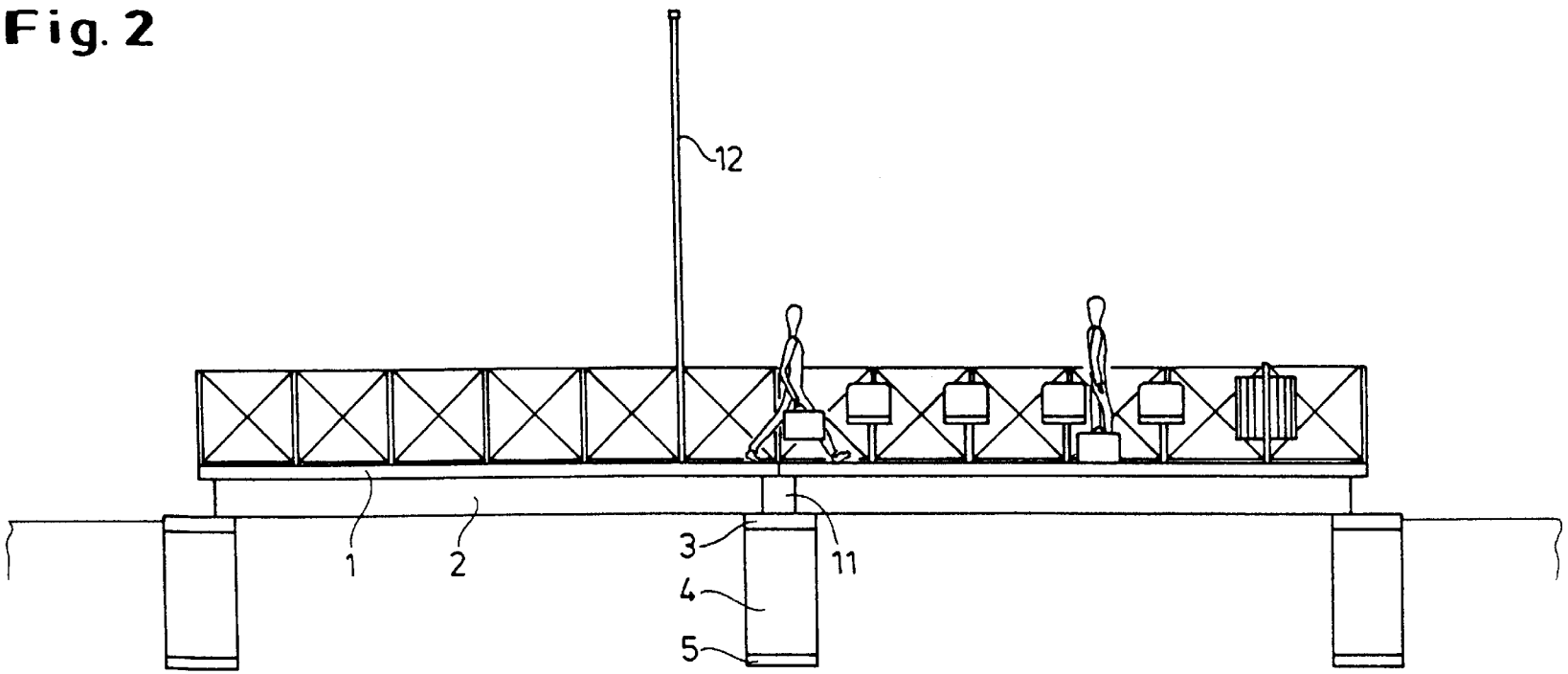
FIG. 2 shows a side view of the platform (system I).

FIG. 2 shows the construction according to the invention diagrammatically in a side view. Here, in particular, longitudinal beams 2 can also be seen, which are molded onto the underside of the platform slabs 1 and provide stability there in the longitudinal direction. Likewise, support beams arranged in the transverse direction (cf. reference 2 in FIGS. 1 and 3) provide the stability of the platform slabs in the transverse direction. FIG. 2 furthermore clearly shows the projection of the platform slab 1 over the support beams 2. The projection on the narrow side, in particular, makes it possible to vary the shape of the platform slab, without changing the frame of the support beams, in such a way (differing from the rectangular shape) that the fitted-together platform slabs adapt to given radii of curvature. For this purpose, the platform slabs are preferably trapezoidal. Moreover, the projections at the joints below the platform slabs 1 form openings 11 for transverse lines. Furthermore, some structures are illustrated in FIG. 2 by way of example, e.g. a lamppost 12 which can be positioned anywhere, railings, seating, trash cans, etc.

Figure 3A:
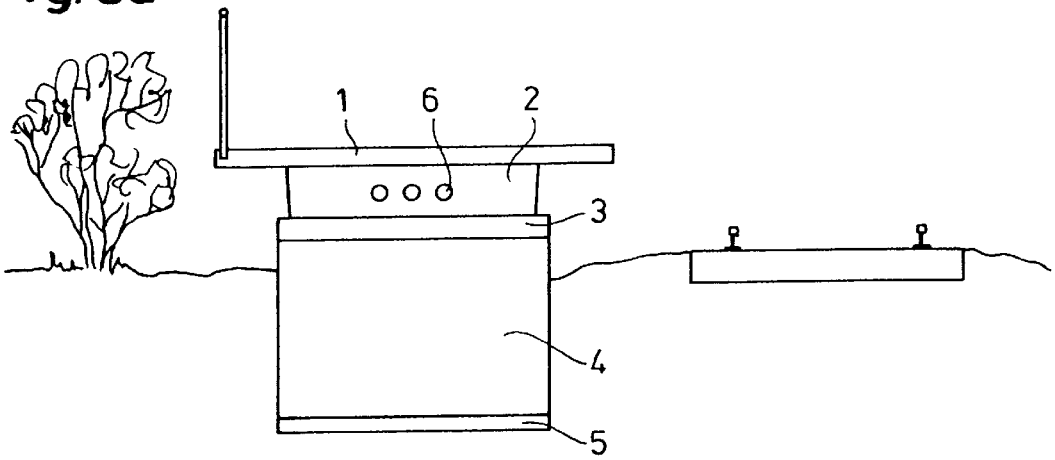
FIG. 3*a* shows a front view (cross section) of the platform with one-piece foundations.

FIG. 3 shows two variants of the platform according to the invention in a front view. FIG. 3*a* relates to the version with one-piece concrete foundations 4 cast in situ. The structure of the granular subbase 5, foundation 4, spacer elements 3 and platform slab 1 with support beams 2 (running transversely) can also be seen here. In addition, empty pipes 6 can be seen, which run centrally below the platform slab 1 and may serve, for example, as cable ducts. At the end face of the platform slab, the empty pipes 6 pass through the transverse support beam 2.

Figure 3B:
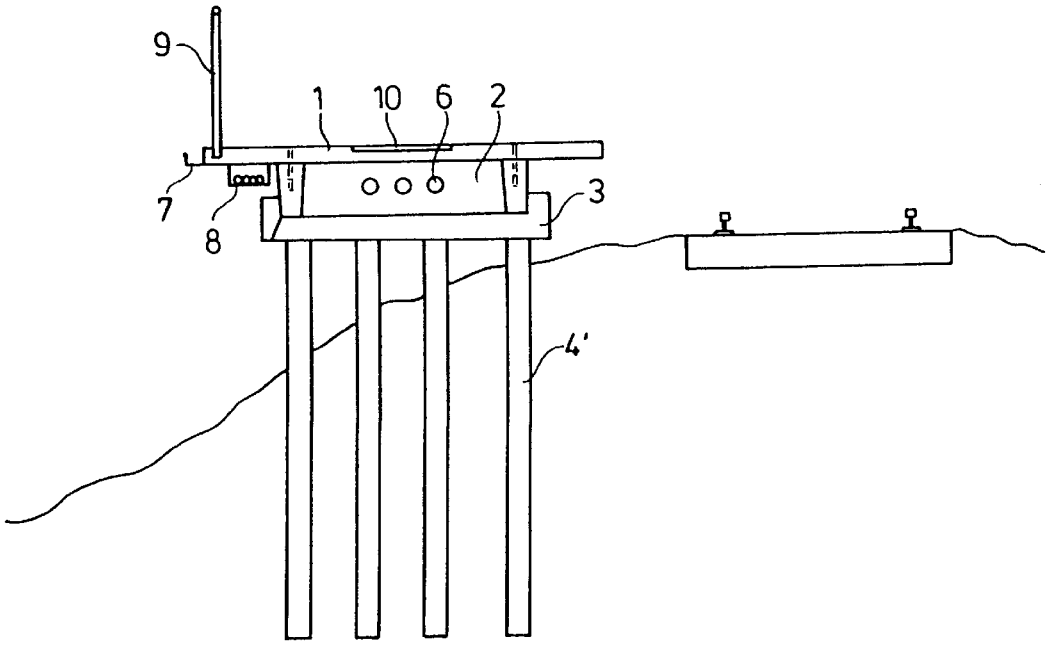
FIG. 3*b* shows a front view (cross section) of the platform with pile foundations.

FIG. 3*b* represents a similar basic structure, but here the platform is built on a pile foundation with the piles 4'. This construction should be given preference under difficult terrain and soil conditions, e.g. if the platform is erected on an embankment. Located on the piles 4' are the spacer elements 3 which may be formed as pile top beams. Furthermore, FIG. 3*b* shows the drainage channels 7, arranged laterally at the platform edge, a cable trough 8, empty pipes 6, a railing 9 mounted in insertion holes and a service hatch 10.

Figure 4:
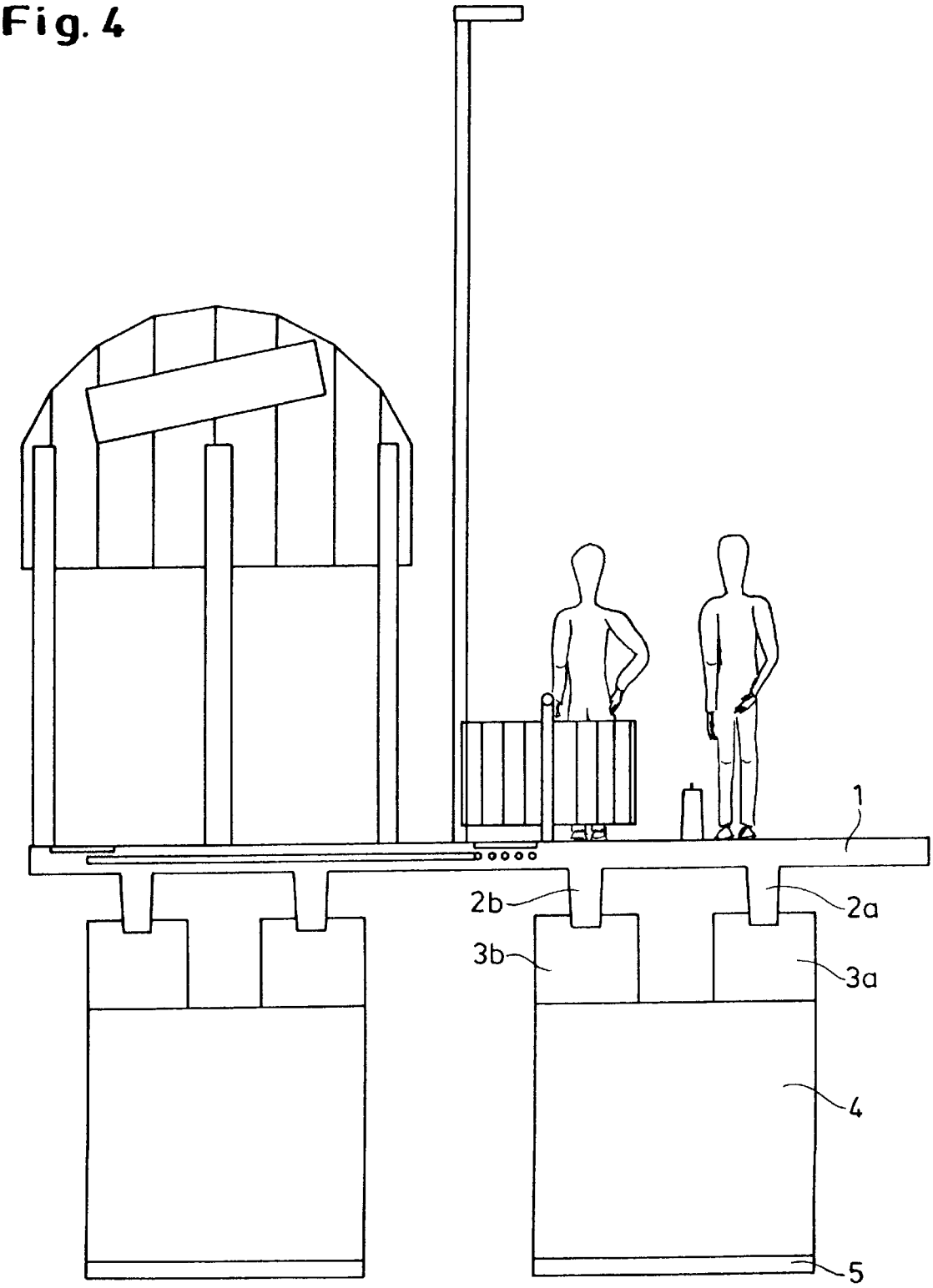
FIG. 4 shows a front view (cross section) of two parallel platforms with multiple-piece spacer elements.

FIG. 4 shows the front view of a platform of alternative design. It can be seen firstly that there are actually two platforms running parallel to one another and together forming a platform of double width. The two platforms are each founded separately on the known structure of the granular subbase 5, foundation 4, spacer elements 3 and platform slabs 1. Structures such as, for example, weather shelters and lighting means are indicated on the platforms. These may preferably be connected to the platform slabs 1 in preassembled mounting sleeves.

The main feature in the structure according to FIG. 4 are the two-piece spacer elements 3*a*, 3*b*. These provide two supporting points in which the longitudinal support beams 2*a*, 2*b* are placed. The two-piece division of the spacer elements 3 makes it possible to influence the transverse inclination of the platform slab 1. For this purpose, spacer elements 3*a*, 3*b* of unequal height may be selected. It is thus possible either to compensate any inclination of the foundation 4 differing from the horizontal plane or to produce an appropriate inclination of the platform slab 1.

It can furthermore be seen in FIG. 4 that the platform slab 1 and spacer elements 3*a*, 3*b*, on the one hand, and the spacer elements 3*a*, 3*b* and the foundation 4, on the other hand, mesh with one another due to complementary shaping. For instance, the spacer elements 3*a*, 3*b* have depressions on their top side, into which the longitudinal support beams 2*a*, 2*b* are inserted. Likewise, the spacer elements 3*a*, 3*b* engage, for their part, with projections in corresponding depressions in the foundations 4. In this way, it is ensured without further permanent connection means between the construction elements that the corresponding arrangement is stable against loading by transverse forces.

Figure 5:
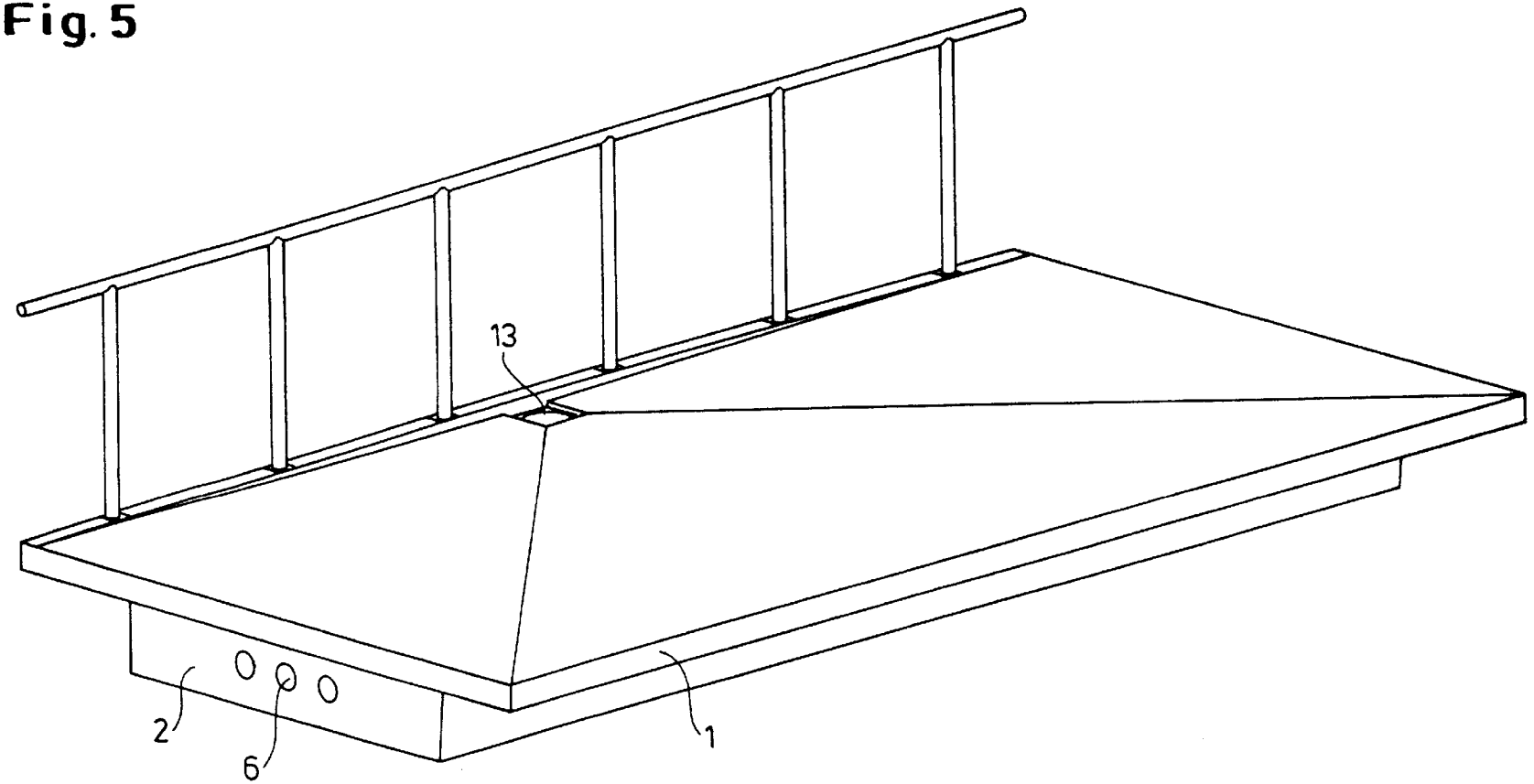
FIG. 5 shows a perspective of the platform slab with an inverted roof profile.

FIG. 5 shows a perspective view of a platform slab 1, in which a depression is produced in the surface by an "inverted roof profile", in the lowest point of which depression the drainage-water outlet 13 is arranged. Of course, other shapes of the surface can also be implemented depending on requirements and the desired drainage-water collection point.

Figure 6:
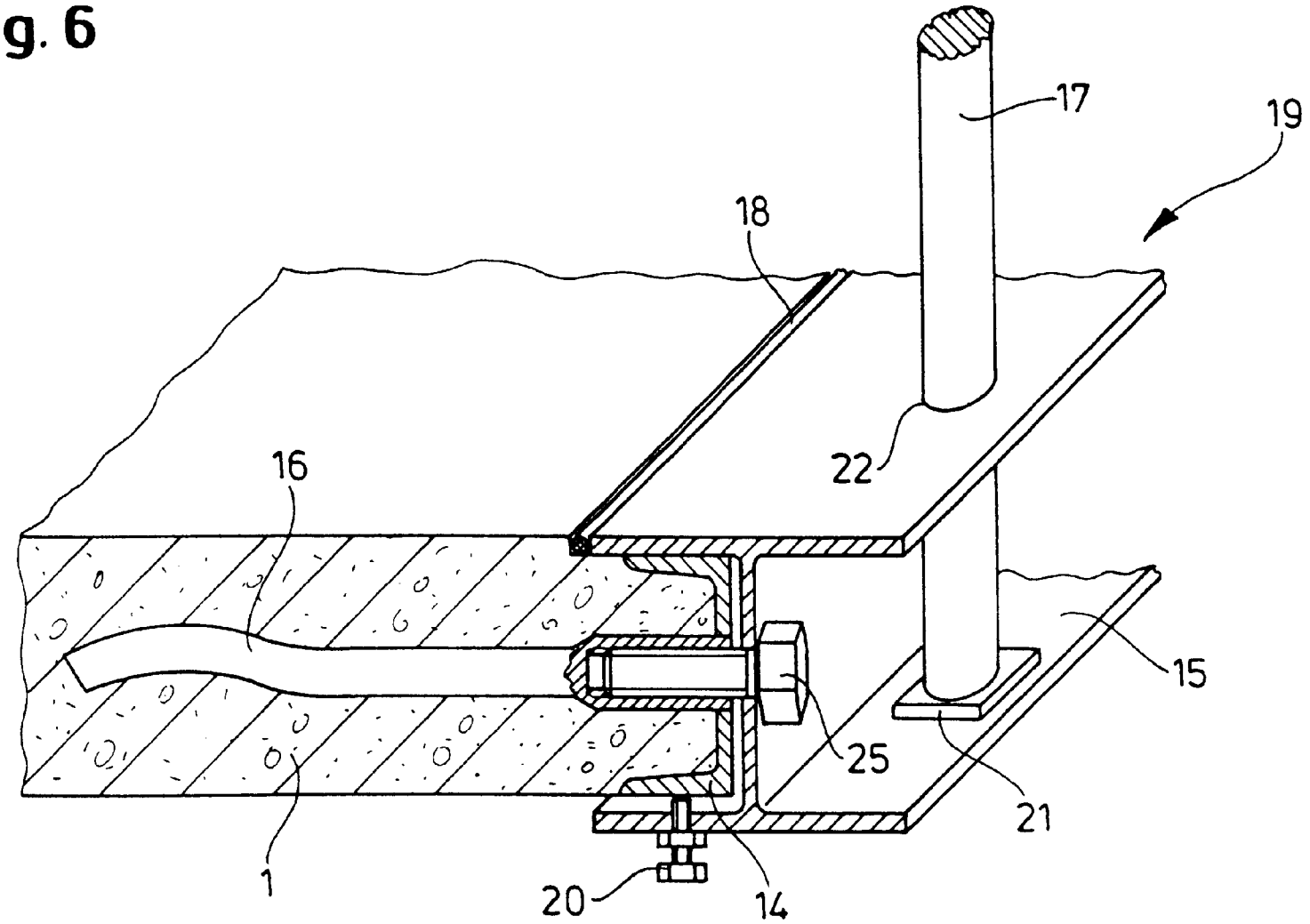
FIG. 6 shows the slab edge remote from the track with a mounting support.

FIG. 6 shows a detail of the slab side remote from the track. A C-profile 14 which serves to reinforce the edge and the I-profile 15 (wide flange support of HEA or HEB design) to be fitted during construction can be seen. The non-positive connection to the slab 1 is produced by means of threaded sleeves 16 with an undulating anchor, e.g. of the PFEIFFER type, a threaded rod and a nut 25 which can easily be accessed from the outside. Railing supports 17, for example, can be attached through openings in the upper flange, which have either already been produced beforehand to fixed grid dimensions or are produced during construction according to requirements, so as to be stable in terms of torque and easy to assemble. Their attachment is accomplished in the lower region, for example, in a footing 21 with a screw thread. The assembly time can be additionally shortened if the fitting elements have already been completely connected to the support 19 (screwed or welded) before they are screwed together with the system slab 1.

The mounting support 19 can be placed flush against the concrete surface through a corresponding cutout in the slab 1 and attached by means of a permanently elastic joint 18. However, to improve the conducting-away of the water in the design variant "drainage with an inverted roof profile", the support can also be installed in such a way that the top side of the flange projects above the concrete surface.

As further variations, for the attachment rail described, other materials (special steel, aluminum, plastics) or different profiles (fitted-together C-profiles instead of I-supports, special shapes) may also be provided. Instead of the described receptacle for the railing supports, an attachment may also be made solely on the top or on the bottom flange.

When the mounting support 19 is connected to the system slab 1, an adjustment can firstly be made by means of screws 20 located on the underside of the flange, before it is screwed finally into the cast-in threaded sleeves 16.

Figure 7:
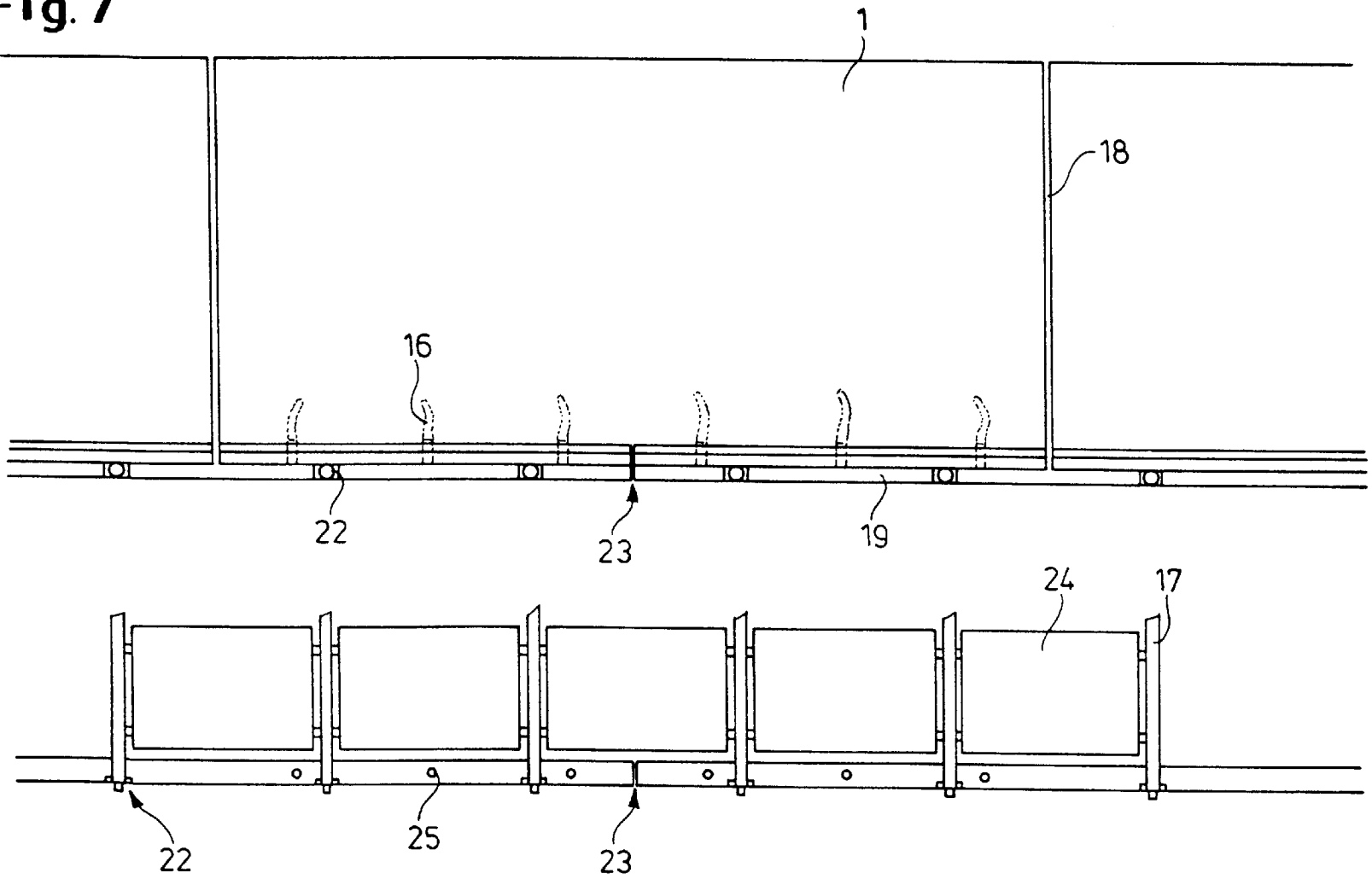
FIG. 7 shows a diagrammatic plan view and side view with a mounting support.

FIG. 7 shows the C-profile and I-profile in a diagrammatic plan view and a side view (side remote from the track).

Figure 8:
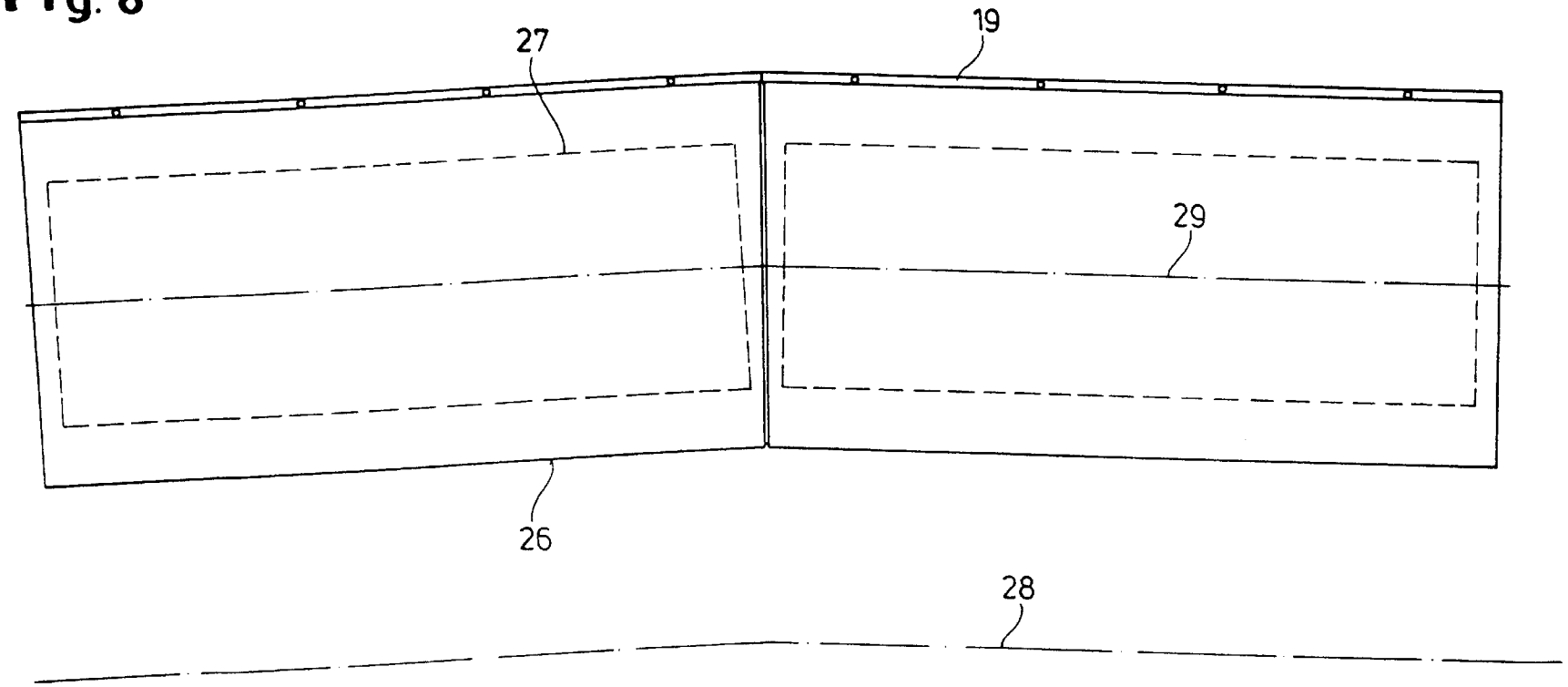
FIG. 8 shows a diagram of a curve adaptation.

FIG. 8 shows the adaptation of the track-side slab edges 26 to given radii. Since all the slab edges extend beyond the supporting construction 27 (projecting slabs), the edges can be varied without putting the safety of support of the slab at risk. The track-side edge 26 can be made to be convex, concave or oblique.

Figure 9:
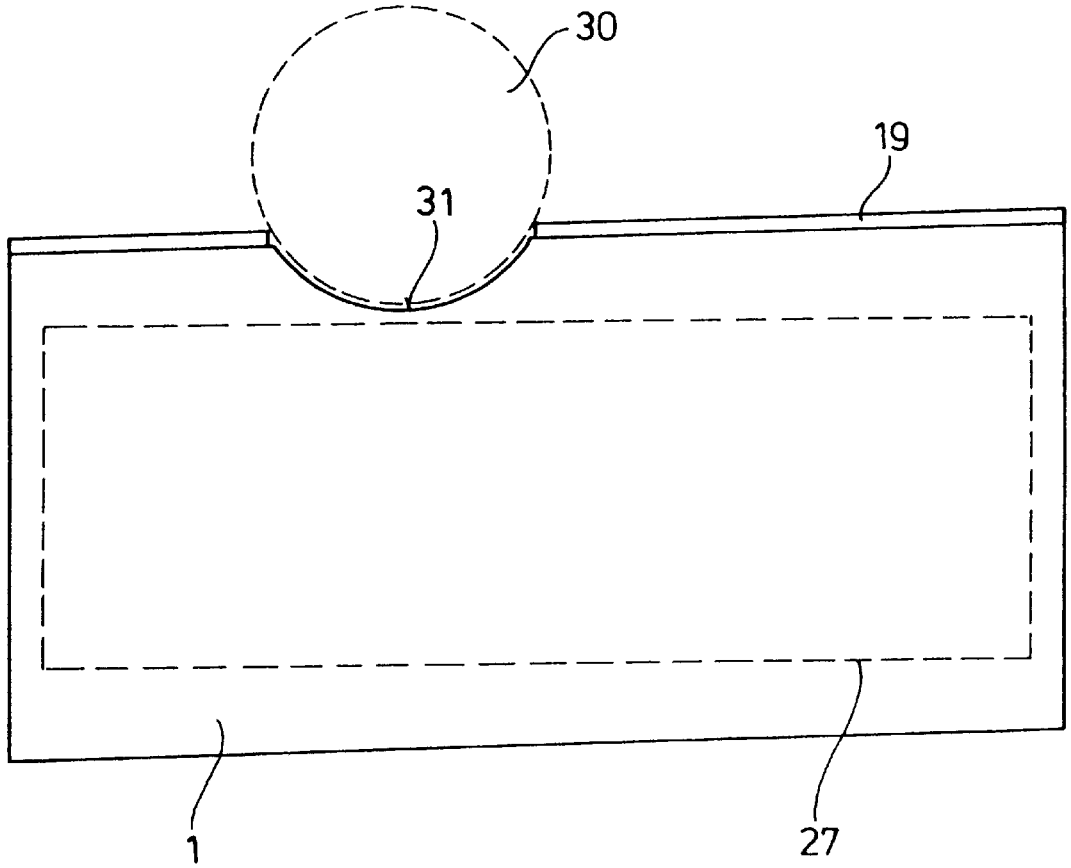
FIG. 9 shows a diagram of a cutout.

FIG. 9 shows the possibility of likewise varying the course of the edge on the side remote from the track without putting the safety of support at risk. For instance, any natural barriers 30, for example, (such as a projecting rock or a tree) can be "avoided" or included in the design.

Figure 10:
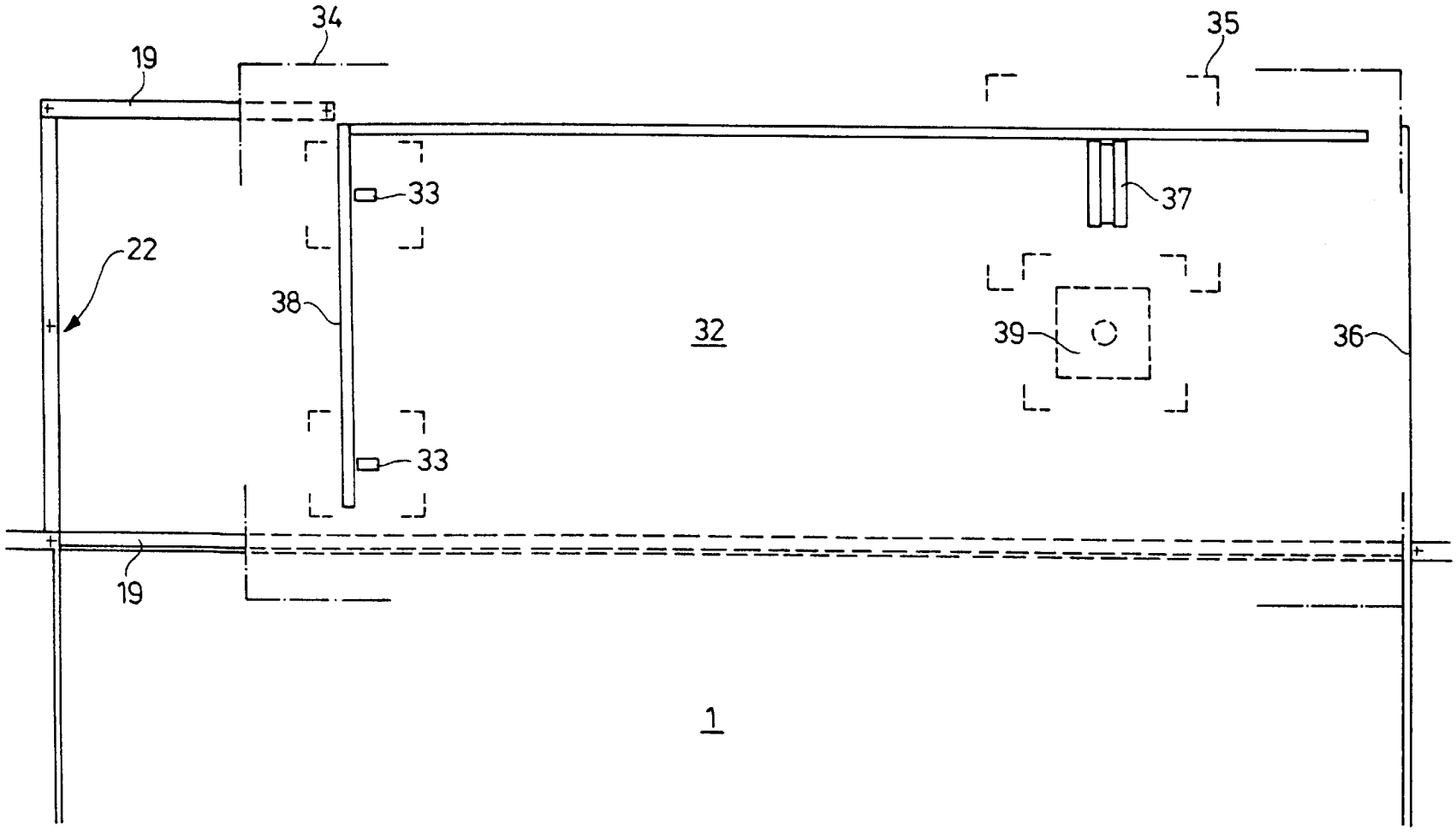
FIG. 10 shows a diagram of the connection of an attachment slab to the system slab for the foundation of a weather shelter.

FIG. 10 shows the connection of an attachment slab 32 to the system slab 1 in order, for example, to attach a weather shelter on it. The transition between the two slabs is made by the mounting support 19. The attachment slab 32 can also be connected to the system slabs fitted with a mounting support at a later date.

Figure 11:
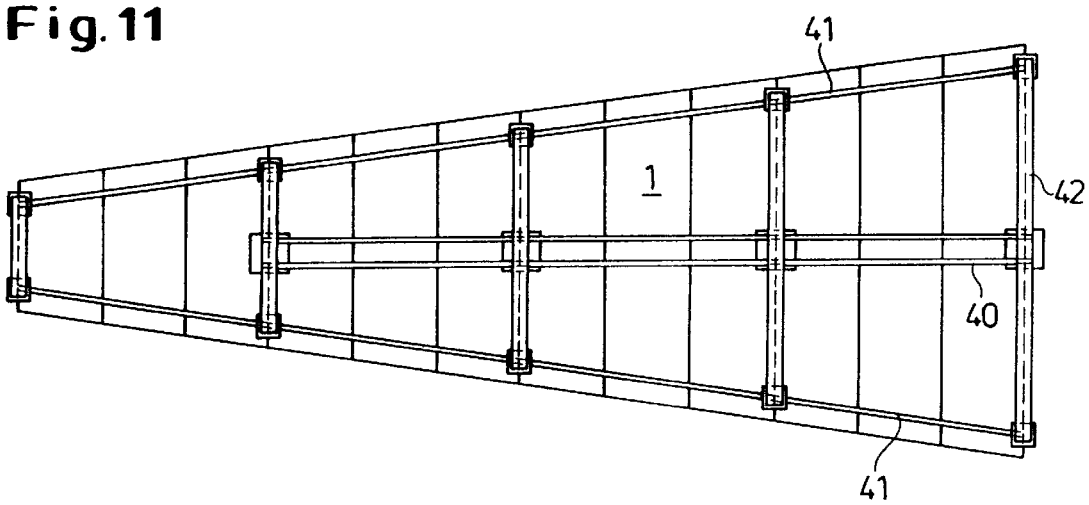
FIG. 11 shows the systems II and III as a basic sketch.

FIG. 11 shows the systems II and III in plan view as a basic sketch. It illustrates part of a central platform which tapers toward the end. System II consists of two or more slabs 1 which are located adjacent to one another in the platform width. Illustrated in plan view is the continuous trough element 40 in the center, the two edge elements 41 continuing over the length, and the ground beams 42 extending with a grid size of, for example, 9 m over the entire platform width. System III begins where the width of the platform permits a single slab. The weight and transport size of the slab are the criteria here. A 7 m wide and 3 m long slab which tapers toward one side is illustrated as an example. The slabs of the system III rest on the two edge beams 41 located on the outside and partially on the ground beam 42, every 9 m in the example.

Figure 12:
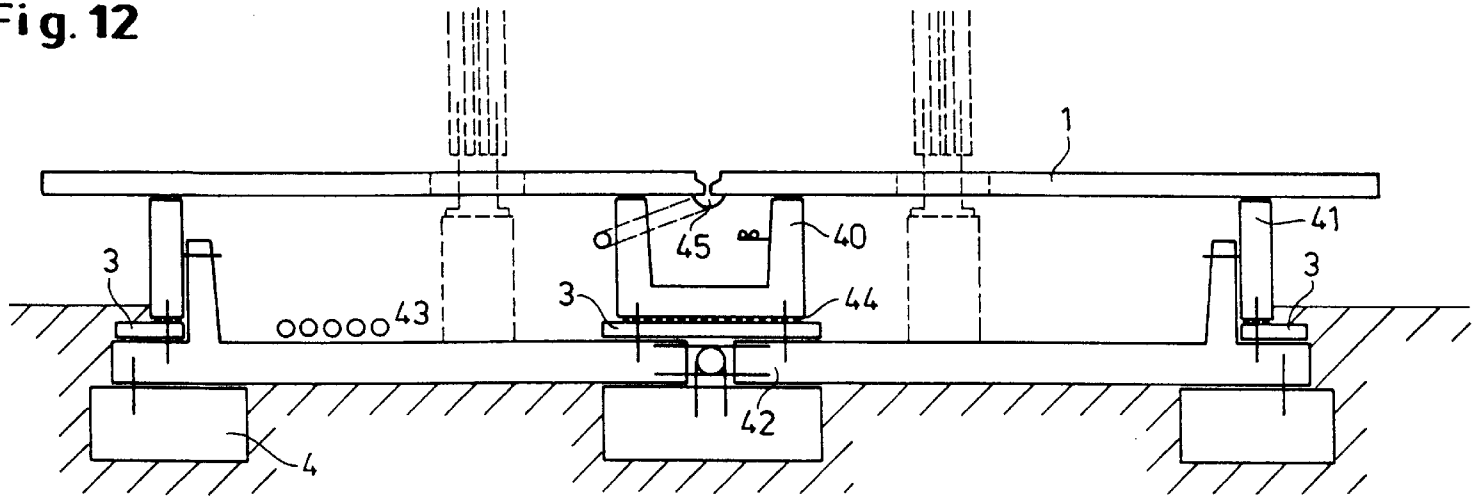
FIG. 12 shows the cross section of the platform system II.

FIG. 12 shows the cross section of the platform system II. It can be seen in the figure that there is a hollow space on both sides of the trough element 40, in which space supply lines 42 or even other ducts can be accommodated. A possible attachment or foundation of platform structures, such as for example platform roofs, etc., is also indicated. The raising or lowering of the platform is effected by means of a spacer element 3 below the edge support 41. Said spacer element is not continuous along the length, but is placed in each case on the ground beams 42. Between the edge support 41 and spacer element 3 there is a neoprene support 44. Drainage takes place in the figure via a semi-channel 45 in the middle between the two platform slabs. The water can be conducted away via a cutout in the trough element 40. Lateral displacement of the platform slab 1 at a later date is possible by enlarging the distance between the two slabs in the middle (a larger semi-channel 45 may be fitted). In this case, both platform slabs may be pushed toward the track. Lateral displacement to one side takes place by displacing the complete system above the concrete foundation 4 cast in situ. The edge support 41 may be provided with a sound-absorbing surface toward the outside.

Figure 13:
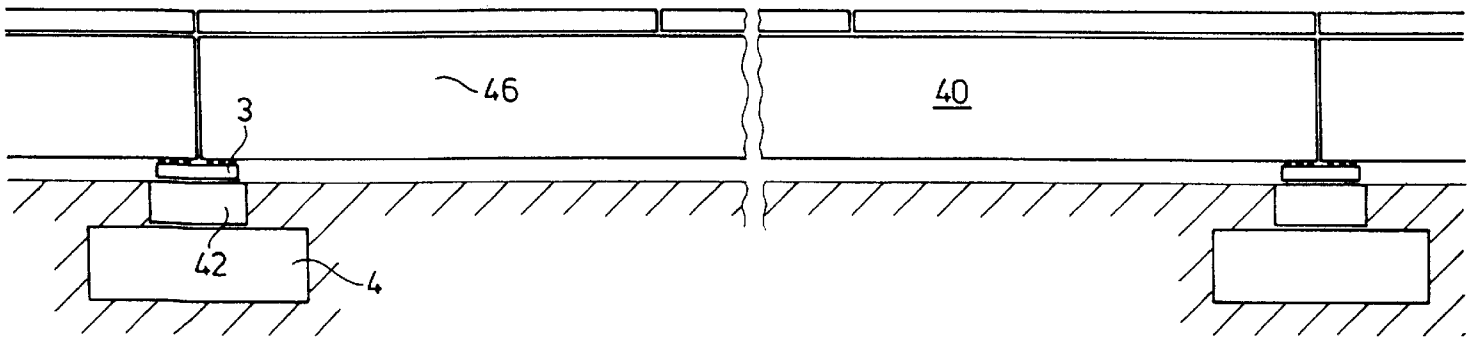
FIG. 13 shows a longitudinal section of the platform system II.

FIG. 13 shows the longitudinal section of the same platform, namely system II. Access to the interior of the trough channel 40, as occasionally required, for example in order to change the drainage line, is possible via an access hole 46 at the side. Access to the hollow space between the trough channel and edge beam can be provided via a shaft cover in the platform slab, the surface of which cover can be matched in color.

Figure 14:
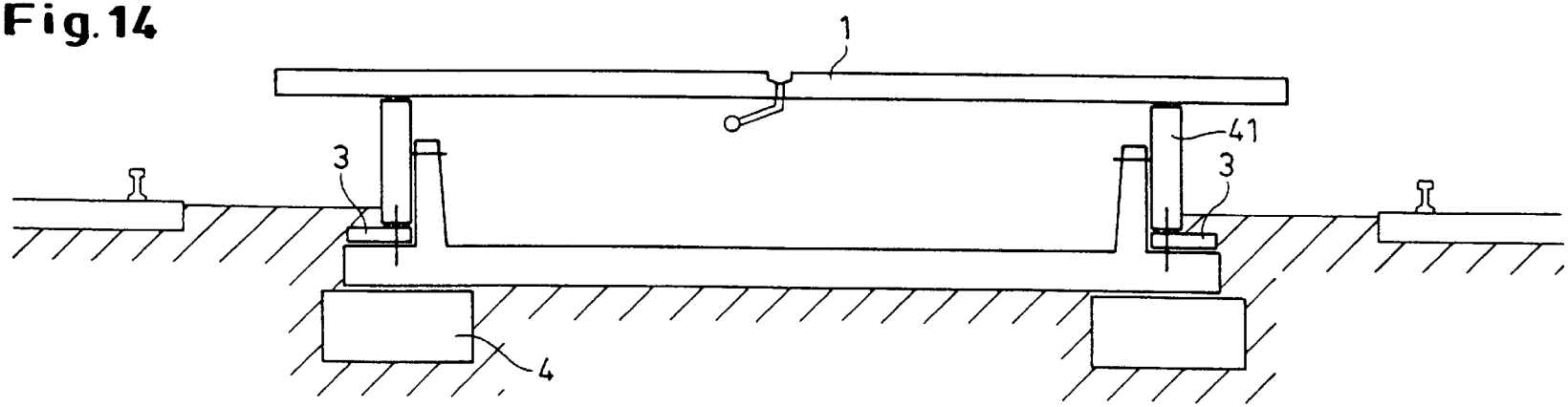
FIG. 14 shows the cross section of the platform system III.

FIG. 14 shows the cross section of the platform system III. The structure is similar to system I, but without a central trough and with only one slab 1 over the entire platform width.

Figure 15:
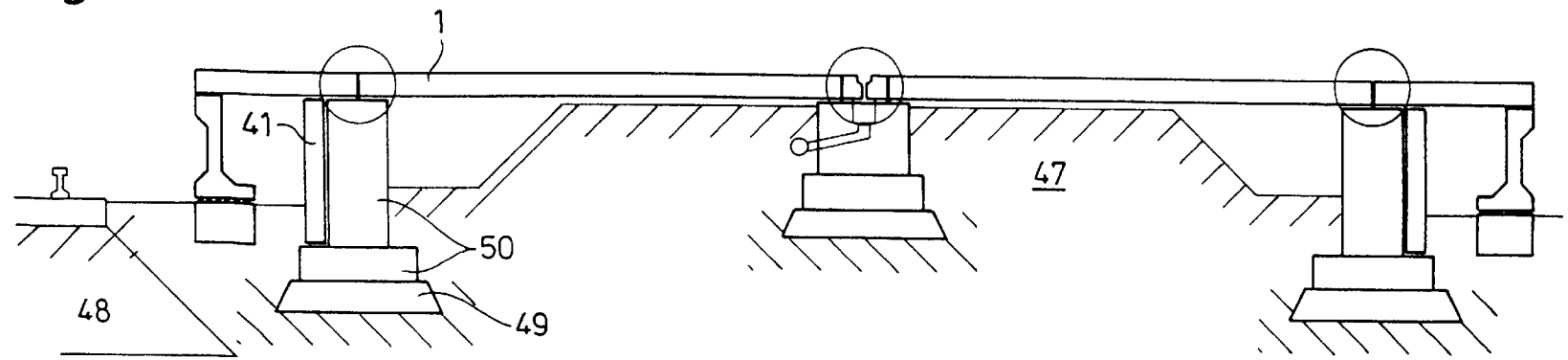
FIG. 15 shows the cross section of the platform system IV.
Figure 17:
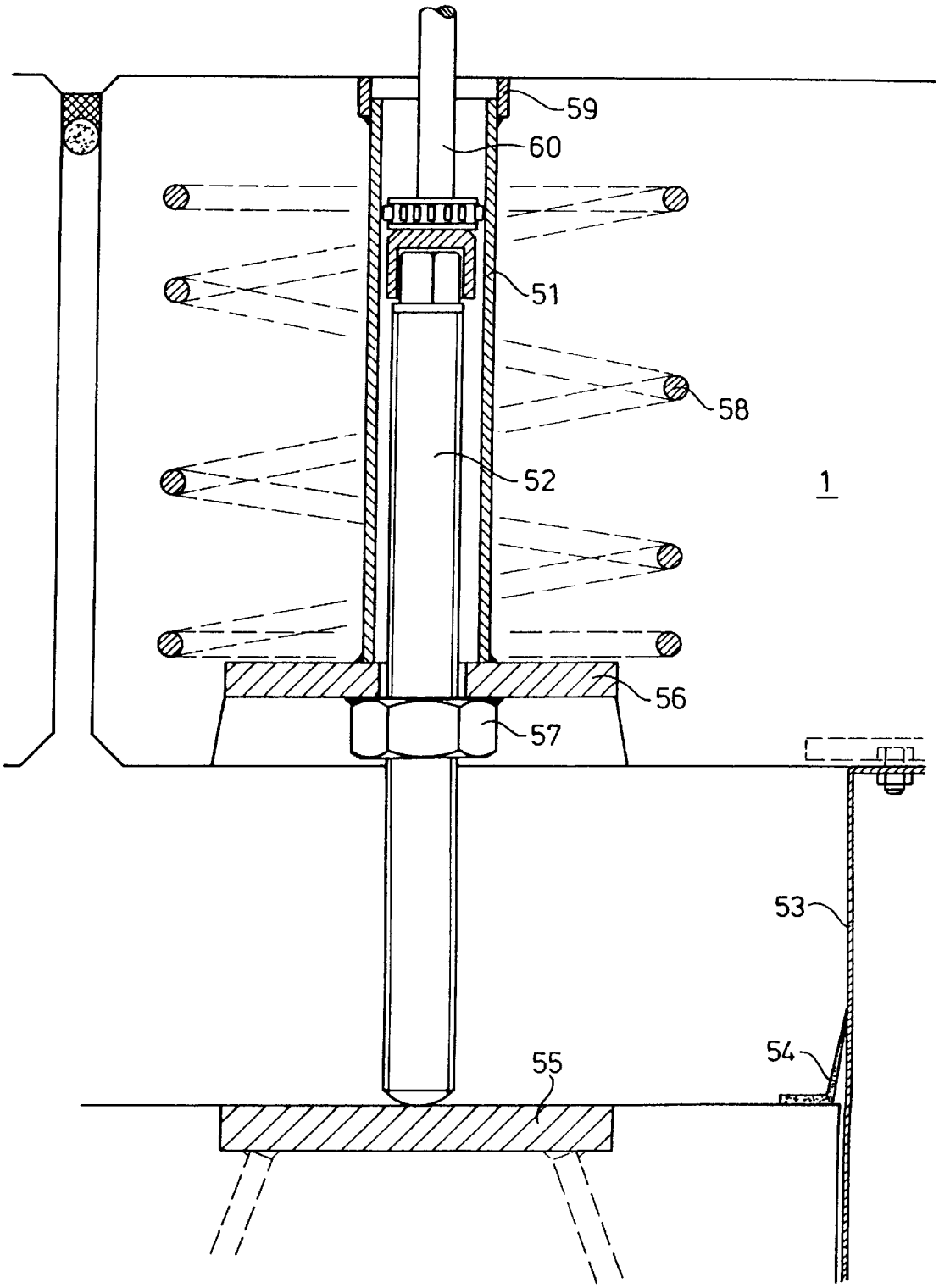
FIG. 17 shows the height-adjustability for system IV.

FIG. 15 shows the cross section of the system IV. It can be seen in the figure that an old existing platform 47 does not have to be removed completely. The two platform slabs 1 (with a lesser width, e.g. <7 m, one platform slab is also conceivable) are mounted in the center on a foundation with a prefabricated part located above. In this system, raising is possible, for which details are illustrated in FIG. 17. The edge beams 41 may be covered with a sound-absorbing surface or produced from a large-pored concrete on the surface. This figure also illustrates the fact that the foundation is so remote from the railroad tie that it is not contacted by the load spread 48 extending at about 45° below the railroad tie, i.e. operation of the track is not affected while the foundations are being installed. The foundations are composed of a lean concrete layer 49 on an antifrost base and with two prefabricated foundations 50 placed on top.

Figure 16:
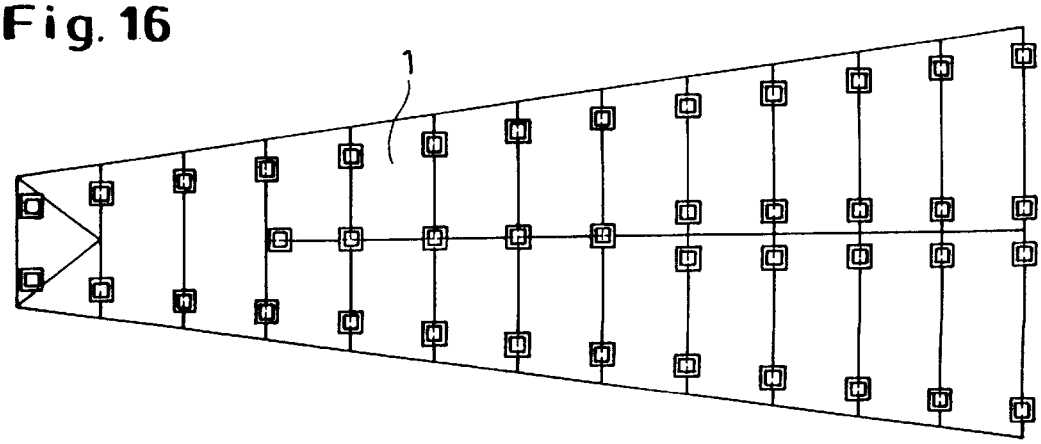
FIG. 16 shows the foundation and drainage system (system IV).

FIG. 16 shows how the foundations are arranged in system IV and how the drainage of the platform can be envisaged. In the less wide parts of the platform in which only one slab 1 is provided over the entire width, each slab has its own inclination toward a point. These inclinations may already be provided in the slab in this way at the prefabrication works. In the area where there are two or more slabs, drainage takes place in the middle between the two slabs.

FIG. 17 shows the detail of height adjustability in system IV. The platform slab 1 can be varied in height by an anchor 52 (e.g. M20–M27) of the appropriate length being introduced into the steel tube 51 illustrated (e.g. diameter/thickness=35/2.5 mm or 38/4 mm) and the slab 1 thus being screwed upward. In the process, the anchor 52 is supported at the bottom on a footing 55 (e.g. 120×120×12 mm) which is anchored in the concrete foundation. Located in the slab 1 is a base plate 56 (e.g. 120×120×12 mm) which is welded to the standing tube 51 and a nut 57 (e.g. M20–M27). Located around the standing tube 51 in the slab 1 is a spiral reinforcement 58. Toward the surface of the platform, the standing tube 51 is gripped by a closable attachment ring 59 which is ground at the top. The height is adjusted by turning the anchor 52, which can be carried out, for example, by means of an electric screwdriver 60 with a roller bearing guide.

The gap which arises can be filled with concrete via the joint between the two slabs. The adjustment is ensured by means of the illustrated metal sliding box 53, and the seal by means of a neoprene lip seal 54. When filled with concrete, however, this system can no longer be lowered at a later date.

Figure 18:
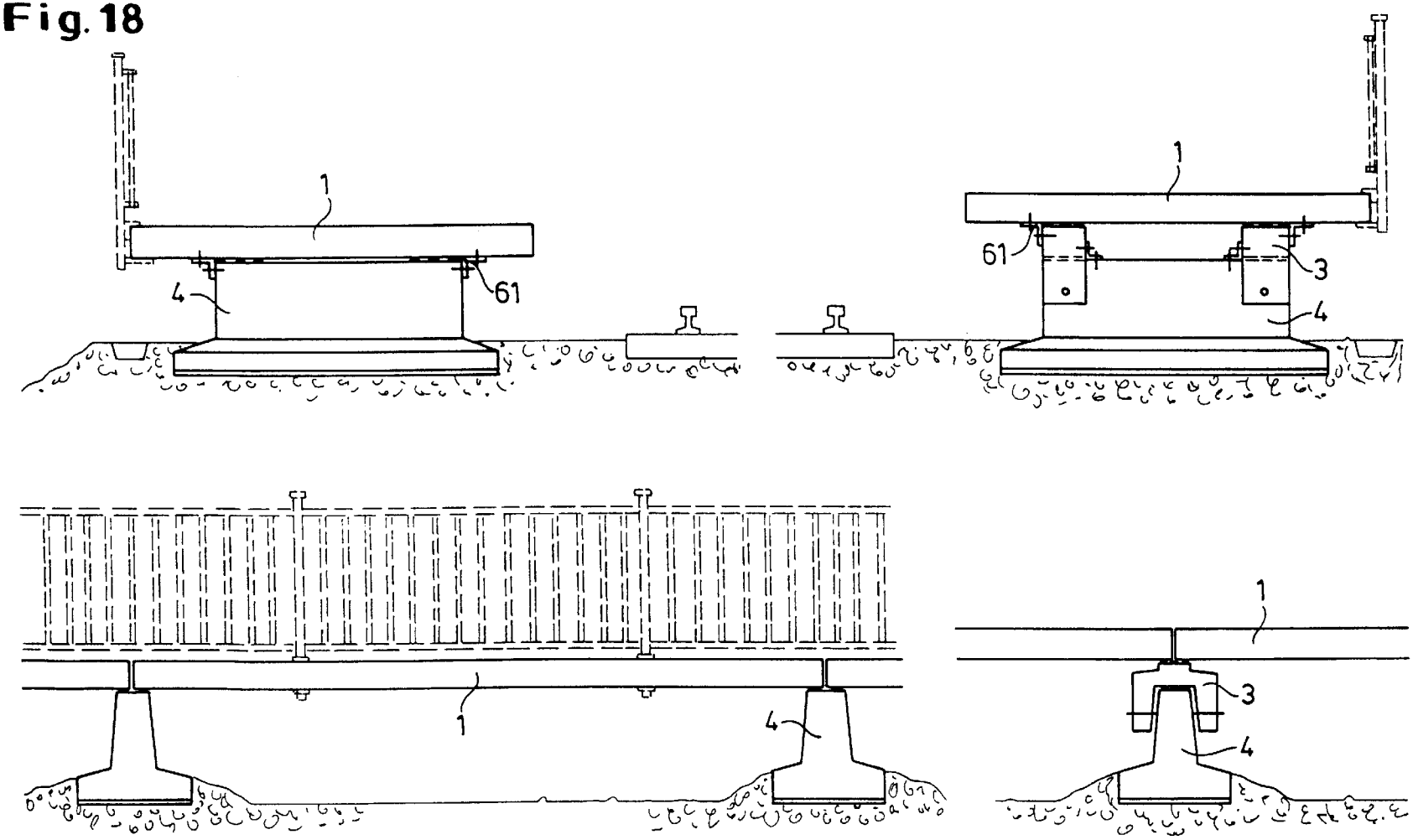
FIG. 18 shows a provisional platform.

FIG. 18 shows a provisional station platform which may be used, for example, in the following cases:

1. As a long-term provisional construction for whole construction phases (several weeks or months). In this case, the position of the provisional platform may be the same or not the same as the end position of the platform.
2. As an advance measure, i.e. in the construction state, the platform is installed in advance at a provisional position. Later, the same system is installed in the final condition position and remains there.
3. As a temporary platform extension. This may be necessary if a longer track is ordered for a limited period from the station provider.

The dimensions of the provisional platform are variable. Its width is preferably between 2.40 m and 3.00 m. The length is preferably between 6 and 9 m, so that the costs can be minimized for this system too and simple equipment technology can be applied. Since the provisional platform is intended to be installed several times at different sites, generally only specific grids are used. The provisional platform consists of prefabricated foundations 4 and a prefabricated slab 1 which rests on said foundations and is secured against unintentional lateral displacement by means of stainless-steel angles 61. The projecting part can be varied as in the other systems. The prefabricated foundation [sic] are seated on a gravel bed and a thin layer of sand. Since the edges of provisional platforms are straight, profiled plates made of galvanized steel or special steel are provided in the bottom position to cover the expansion joint. In the upright position, said joint is filled with a permanently elastic compound. Railings and platform structures which are not too heavy can be mounted at the outer edge by means of stainless steel angles. Lampposts, etc. generally have to be founded separately behind the platform edge. Cable ducting takes place via the free space below the platform slab. In this case, cutouts for empty pipes are to be provided in the foundations. In order to ensure height-adjustability, it is possible to provide a prefabricated intermediate piece 3 whose supporting surface toward the prefabricated concrete slab must not be greater than the original supporting surface of the prefabricated foundation so that the loads emanating from the slab go vertically into the foundation (supporting surface about 20 cm).

Figure 19:
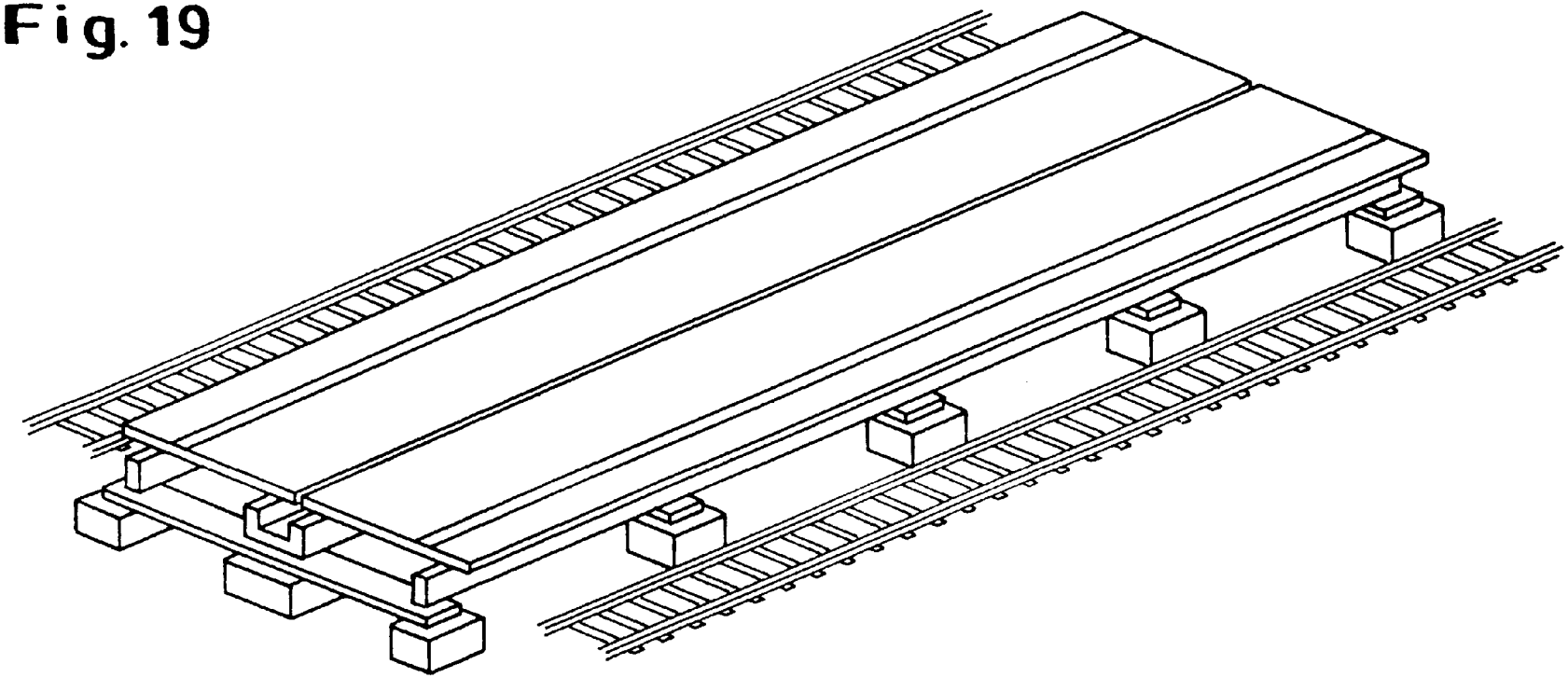
FIG. 19 shows a perspective view of a medium platform.

FIG. 19 shows a perspective view of a central platform of the type described above to provide a better depiction.

With the arrangements described by way of example in the figures, numerous advantages can be achieved compared to the known systems:

When refurbishing conventionally erected platforms using the system platform according to the invention, the old platform edges and the backfilling can largely remain in place, movements of large masses can be avoided, and expensive landfill fees can be saved. Without impeding the rail operation, the system platform is mounted during breaks in operation by means of two-way system vehicles or cranes and can be used immediately. The system allows preparatory work to produce the platform, such as for example excavation, installation of foundations, to be carried out outside the pressure area of the adjacent track, unless transportation by rail is required. Costs to ensure operation and places of slow travel can thus be minimized. When the horizontal and/or vertical position of the platform is changed, all the parts can be reused.

The system platform is based on a prefabricated skeleton of modular construction, with which a new modern platform can be installed on top of a damaged platform or on the earth adjoining the plane within an extremely short construction time.

By means of the installation or removal of prefabricated spacers, the height of the platform can be varied in stages at any time without great effort between 38 cm üSO (above the top edge of the rails) and 96 cm üSO.

The color, structure and texture of the surface covering can be specified individually in consultation with the client and produced to a consistently high quality.

On account of the properties of the system platform, platform refurbishments can be accomplished in a cost-effective manner without great effort. The old platform can remain in place, narrow ditches for the supporting bodies have to be installed at 5–8 m intervals; in total, movements of masses are only small and there are correspondingly low disposal costs which are not only of interest economically, but also show that the system platform has ecological advantages over conventionally erected platforms. In this case, a high level of flexibility is also guaranteed for the future. The slabs are moved using two-way system vehicles or nonprofile rail-mounted cranes, and the spacers are easily adapted to the required level. In curved positions up to a radius of 300 m, the platform slabs are adapted in an optimum manner to the course of curvature, and passengers are able to enter the vehicle without any wide gaps. In the system platform, empty pipes for cable runs of all types, mounting sleeves for platform fitting elements and support foundations for weather shelters can already be incorporated from the works. Width and length parameters are tailored to the application and the existing means of transport, or to a given grid size of the user.

Moreover, relatively large structures, such as for example roofs or weather shelters can also be incorporated as specified by the user, either in accordance with a detailed sketch by connecting the required foundations to the ground beam or as individual founding by means of a cutout in the system slab.

On account of the prefabrication of the system components, the construction period can be extremely short, the work can take place during breaks in operation, and no sites of slow travel have to be set up. There are various design options to complete the textures and patterns for the surface covering, which also applies to the choice of fittings. It is likewise possible to incorporate automatic deicing systems based on electrical underfloor heating or to use the space below the system platform slab as a bike & rail station with lockable bicycle cubicles, as a place for left baggage, etc.

Existing or planned depth drainage systems of adjacent tracks are taken into account individually by means of cutouts in the foundation of the platform.

Standardized traffic loads at the level of 5 $kN/m^2$ for passenger traffic and 5 $kN/m^2$ for a 3 t baggage vehicle according to DS 804 Clause 105, Volume 29 of DB AG can be applied as load factors. The introduction of punctiform special loads, for example for supports of weather shelters or the like, are possible and are admissible on a large scale without changing the plans.

All the components are produced in accordance with the regulations and provisions of DIN 1045 and ZTVK 88 and are resistant to frost and deicing salt.

Safety and guidance systems are designed to conform not only to German laws, but also to the stringent American standards, such as the American Act for the Blind (ADA) and the Council for the Blind (ACB). Ramps in accordance with DIN 18024 for wheelchair-bound passengers are provided at the access to the system platform, as are bicycle grooves on stairs in order to make it easier to take bicycles and to encourage the environmentally friendly behavior of bike & ride or bike & rail.

A special reinforced concrete prefabricated part can be used as the main component for the system platform of system I, which is based in its construction on the structural system of a $\pi$ slab.

The choice of such a construction element which is used with great success in industrial and residential buildings, obviates the need for a beam support. Production costs and installation outlay can be minimized.

The slab thickness (or web height in system I) of the system slab are sufficiently dimensioned for all conceivable conditions of use. The weight and dimensions of the element are adapted to the tools used in rail construction and the existing headroom.

In systems II, III, IV, the slabs are connected to one another appropriately in the middle of the self-supporting surface in order to permanently compensate for height differences which have occurred due to bending or production.

Prefabricated parts made of reinforced concrete are likewise used as supporting elements, thus ensuring height-adjustability in stages from 38 cm üSO up to 96 cm üSO.

The actual foundation is made in concrete cast in situ. The dimensions of the building pits to be produced for this purpose are generally selected to ensure that the stability of the gravel bed is not put at risk and no timbering is necessary.

For the event of a future change in level, demountable connections ensure rapid reconstruction without difficulty. The transport anchors usually arranged in the surface of prefabricated parts are avoided here in order not to obstruct the uniform appearance of the surface, in that the slabs are moved by means of belts.

The foundations are dimensioned to ensure that the permissible soil pressure in accordance with DIN 1054 or Eurocode 7 is maintained. In the event of particularly poor geotechnical conditions, soil stabilizers may be provided in individual cases or deep founding may be necessary.

In principle, any desired surface structures may be implemented. At the request of the user, the covering side, in particular along the track side, is to be fitted with an anti-slip rough structure and guide markings are to be provided, which are essential as a visual and tactile orientation aid for particular groups of people. In this case, special preference should be given to a particular surface quality which is distinguished by a high abrasion value and insensitivity to environmental influences and the use of deicing agents.

In this platform, no additional operation is required to make the surface. Different colors, structures, patterns, coverings can already be produced at the prefabrication works in accordance with the individual requirements of the user. Any required working joints (e.g. in order to separate different colors) are filled with nonshrinking mortar, so as not to cause any loss of the structurally required covering of the reinforcement of at least 3 cm. This is necessary in order to minimize the slab thickness and thus the weight. This joint filling can be sanded with a color, specifically matched to the colors of the surface.

EXAMPLE

Of the area of the platform edge: a 30–50 cm wide strip with a structure providing particularly good grip (e.g. five-piece pattern, checkerplate pattern, other shapes), Of the tactile guide strip: a 25 cm wide guide marking provided with a signal color, e.g. knob structure according to ADA and ACD, Of the platform: plaster structure, various options possible.

The drainage-water is collected in an outlet channel and either fed to the soil in a drainage pit or conducted into the sewers. A transverse inclination of 1–2% of the system platform relative to the side remote from the track or (generally) relative to the center reliably ensures uniform drainage of the water. In the case of different heights of the two tracks leading along the central platform, an even gradient toward the central drainage point is ensured, in that the slab widths can be varied so that an even gradient is maintained from both sides.

In a further possible design, the water can be collected centrally at one or more points by means of a particular inverse profile of the slab surface and fed to a drainage line.

The platform system permits at any point free access to the hollow space below the platform, e.g. via an access shaft. The surface structure is continued in the shaft cover. Cable ducting takes place in system I by means of cable ducts incorporated into the slab, or in the other systems by means of empty pipes arranged below the slab. Cable terminal boxes at regular intervals ensure uncomplicated supply to the platform equipment and permit wiring to be installed at a later date.

Depending on the type and diameter of the wiring, many cables can thus be laid in the slab. A cable trough may optionally be mounted in the space below the slab, which cable trough can accommodate additional wiring, if required, such as for example for the installation of a communication network parallel to the rails. At the same time, the hollow space below the platform slab can accommodate cable ducts. The hollow spaces can be made accessible by means of doors or openings in order to utilize said spaces, for example as a storage area for winter service goods.

In the case of route electrification, the platform slabs and the fitting elements are grounded by means of terminal boxes on the rails in accordance with the provisions and instructions of DIN 57 115 Part 1 (VDE 0115 Part 1).

List of reference numerals

| | | | |
|---|---|---|---|
| 1 | Platform slab | 33 | Support for weather shelter |
| 2 | Support beam | 34 | Roof line of weather shelter |
| 3 | Spacer elements | 35 | Foundation |
| 4 4' | Foundations | 36 | Side wall (glazed) |
| 5 | Granular subbase | 37 | Pylon/support element |
| 6 | Empty pipes | 38 | Attachment element/glass cabinet |
| 7 | Drainage channel | 39 | Support |
| 8 | Cable trough | 40 | Trough element |
| 9 | Railing | 41 | Edge element |
| 10 | Service hatch | 42 | Ground beam |
| 11 | Transverse line | 43 | Supply lines |
| 12 | Lamppost | 44 | Neoprene support |
| 13 | Outlet | 45 | Semi-channel |
| 14 | C-profile | 46 | Access hole |
| 15 | I-profile | 47 | Old platform |
| 16 | Threaded sleeve | 48 | Load spread |
| 17 | Railing support | 49 | Lean concrete layer |
| 18 | Permanently elastic joint | 50 | Prefabricated foundation |
| 19 | Mounting support | 51 | Steel tube |
| 20 | Screws | 52 | Anchor |
| 21 | Footing | 53 | Metal sliding box |
| 22 | Railing receptacle | 54 | Neoprene lip seal |
| 23 | Mounting support joint | 55 | Footing |
| 24 | Glass filling | 56 | Base plate |
| 25 | Screw connection to the platform slab | 57 | Nut |
| 26 | Slab edge to the track | 58 | Spiral reinforcement |
| 27 | Support construction | 59 | Attachment ring |
| 28 | Track axis | 60 | Electric screwdriver |
| 29 | Platform axis | 61 | Angle |
| 30 | Barrier | | |
| 31 | Cutout | | |
| 32 | Attachment slab | | |

What is claimed is:

1. A variable station platform, having one or more platform slabs (1) and foundations (4), which is variable particularly in height, wherein the platform slabs (1) have supporting regions on their underside, within which regions they can be placed at any position on the supporting points of the platform substructure, and/or the platform substructure has supporting regions on its top side, within which the platform slabs (1) can be placed at any position, so that the platform slabs (1) can be arranged in various horizontal positions above the foundations (4), the variable station platform further comprising one or more spacer elements (3) arranged, in the assembled state, between the platform slabs (1) and foundations (4), and which can be replaced without damaging the platform slabs (1), foundations (4) and spacer elements (3), wherein the platform slabs (1) and the spacer elements (3) and/or the spacer elements (3) and the foundations (4) are toothed or have a complementary, meshing shape, so that no unintentional parallel displacement of the parts relative to one another is possible.

2. The variable station platform as claimed in claim 1, wherein the platform slabs (1) are prefabricated components.

3. The variable station platform as claimed in claim 1, wherein the platform slabs (1) can be laid on the spacer elements (3) and/or the spacer elements (3) can be laid on the foundations (4) in various horizontal positions in a stable manner, or the distance between the foundations can be varied.

4. The variable station platform as claimed in claim 1, wherein the platform slab (1) rests, detachably connected, on the spacer elements (3) and/or the spacer elements (3) rest, detachably connected, on the foundations (4), the detachable connection possibly being a screw connection.

5. The variable station platform as claimed in claim 1, wherein the platform slabs (1) and/or the spacer elements (3) extend in one piece over the width of the platform.

6. The variable station platform as claimed in claim 1, wherein at least two spacer elements (3*a*, 3*b*) are arranged between the platform slabs (1) and each foundation (4).

7. The variable station platform as claimed in claim 1, wherein support elements (40, 41) are arranged between the platform slab (1) and the spacer elements (3), these preferably being prefabricated components.

8. The variable station platform as claimed in claim 7, wherein the support elements (40, 41) run parallel to the rail from one foundation to another.

9. The variable station platform as claimed in claim 1, wherein the platform slab (1) is supported on the platform substructure by means of height-adjustable feet (52).

10. The variable station platform as claimed in claim 9, wherein the height-adjustable feet consist of a threaded anchor (52) which can be screwed to different depths into the platform slab (1) or the platform substructure.

11. The variable station platform as claimed in claim 1, wherein the platform slab (1) has parallel support beams (2, 2*a*, 2*b*) molded onto its underside.

12. The variable station platform as claimed in claim 1, wherein the platform slab (1) has mounting sleeves for platform structures.

13. The variable station platform as claimed in claim 1, wherein the platform slab (1) has a profile, which deviates from the plane, to conduct surface water away, in particular a negative profile to collect the surface water in one or more depressions.

14. The variable station platform as claimed in claim 1, wherein the platform slab (1) has a weight of less than 10,000 kg, preferably less than 8000 kg.

15. The variable station platform as claimed in claim 1, wherein the platform slab (1) has a width of 2 to 5 m, preferably 2.5 to 3.0 m, and a length of 4 to 10 m, preferably 5 to 7.5 m.

16. The variable station platform as claimed in claim 1, wherein the platform slab (1) is produced by the use of different compositions of concrete, in particular types of concrete of different color and/or aggregates, preferably using glass-fiber concrete.

17. The variable station platform as claimed in claim 16, wherein the different types of concrete are introduced adjacently, preferably in a grid structure with working joints in the platform slab (1).

18. The variable station platform as claimed in claim 1, wherein the platform slab (1) has a form which is suitable for producing curvatures.

19. The variable station platform as claimed in claim 1 formed as a prefabricated kit.

20. The variable station platform as claimed in claim 1 wherein the spacer elements are prefabricated components.

21. A variable station platform, having one or more platform slabs (1) and foundations (4), which is variable particularly in height, wherein the platform slabs (1) have supporting regions on their underside, within which regions they can be placed at any position on the supporting points of the platform substructure, and/or the platform substructure has supporting regions on its top side, within which the platform slabs (1) can be placed at any position, so that the Platform slabs (1) can be arranged in various horizontal positions above the foundations (4), the variable station platform further comprising one or more spacer elements (3), are arranged, in the assembled state, between the platform slabs (1) and foundations (4), and which can be replaced without damaging the platform slabs (1), foundations (4) and spacer elements (3), and wherein the support elements are support beams (41) or U-shaped trough elements (40), the trough elements (40) preferably lying below two platform slabs (1), which lie adjacently in the platform width, in such a way that each one of the U-limbs supports one of the platform slabs (1).

22. The variable station platform as claimed in claim 11 wherein the spacer elements are prefabricated components.

23. A variable station platform, having one or more platform slabs (1) and foundations (4), which is variable particularly in height, wherein the platform slabs (1) have supporting regions on their underside, within which regions they can be placed at any position on the supporting points of the platform substructure, and/or the platform substructure has supporting regions on its top side, within which the platform slabs (1) can be placed at any position, so that the platform slabs (1) can be arranged in various horizontal positions above the foundations (4), the variable station platform further comprising one or more spacer elements (3) are arranged, in the assembled state, between the platform slabs (1) and foundations (4), and which can be replaced without damaging the platform slabs (1), foundations (4) and spacer elements (3), and wherein ground beams (42) lie between the spacer elements (3) and the foundations (4), which ground beams are preferably prefabricated components and run transversely to the rail direction from one foundation (4) to another (4).

24. The variable station platform as claimed in claim 12 wherein the spacer elements are prefabricated components.

25. A variable station platform, having one or more platform slabs (1) and foundations (4), which is variable particularly in height, wherein the platform slabs (1) have supporting regions on their underside, within which regions they can be placed at any position on the supporting points of the platform substructure, and/or the platform substructure has supporting regions on its top side, within which the platform slabs (1) can be placed at any position, so that the platform slabs (1) can be arranged in various horizontal positions above the foundations (4), wherein the platform slab (1) is supported on the platform substructure by means of height-adjustable feet (52), wherein the height-adjustable feet consist of a threaded anchor (52) which can be screwed to different depths into the platform slab (1) or the platform substructure, and wherein the threaded anchor (52) is braced on a footing (55).

26. A variable station platform, having one or more platform slabs (1) and foundations (4), which is variable particularly in height, wherein the platform slabs (1) have supporting regions on their underside, within which regions they can be placed at any position on the supporting points of the platform substructure, and/or the platform substructure has supporting regions on its top side, within which the platform slabs (1) can be placed at any position, so that the platform slabs (1) can be arranged in various horizontal positions above the foundations (4), wherein cutouts for cable ducts (6) are incorporated into the platform slab (1).

27. A variable station platform, having one or more platform slabs (1) and foundations (4), which is variable particularly in height, wherein the platform slabs (1) have supporting regions on their underside, within which regions they can be placed at any position on the supporting points of the platform substructure, and/or the platform substructure has supporting regions on its top side, within which the platform slabs (1) can be placed at any position, so that the platform slabs (1) can be arranged in various horizontal positions above the foundations (4), wherein the platform slab (1) has a drainage channel (7) running along its longitudinal edge.

28. A variable station platform, having one or more platform slabs (1) and foundations (4), which is variable particularly in height, wherein the platform slabs (1) have supporting regions on their underside, within which regions they can be placed at any position on the supporting points of the platform substructure, and/or the platform substructure has supporting regions on its top side, within which the platform slabs (1) can be placed at any position, so that the platform slabs (1) can be arranged in various horizontal positions above the foundations (4), wherein the platform slab (1) is fitted with an anti-slip surface and/or safety and conduction systems.

* * * * *